US010190364B2

(12) United States Patent
Tachikawa et al.

(10) Patent No.: US 10,190,364 B2
(45) Date of Patent: Jan. 29, 2019

(54) HORIZONTAL BLIND AND METHOD FOR MANUFACTURING HORIZONTAL BLIND

(71) Applicant: TACHIKAWA CORPORATION, Tokyo (JP)

(72) Inventors: Koi Tachikawa, Tokyo (JP); Kazuto Yamagishi, Tokyo (JP); Yoshiyuki Hadano, Tokyo (JP); Tadashi Okamura, Tokyo (JP); Takenobu Ebato, Tokyo (JP)

(73) Assignee: TACHIKAWA CORPORATION, Tokyo (JP)

( * ) Notice: Subject to any disclaimer, the term of this patent is extended or adjusted under 35 U.S.C. 154(b) by 392 days.

(21) Appl. No.: 14/389,661

(22) PCT Filed: Mar. 28, 2013

(86) PCT No.: PCT/JP2013/059302
§ 371 (c)(1),
(2) Date: Sep. 30, 2014

(87) PCT Pub. No.: WO2013/147039
PCT Pub. Date: Oct. 3, 2013

(65) Prior Publication Data

US 2015/0075728 A1 Mar. 19, 2015

(30) Foreign Application Priority Data

Mar. 30, 2012 (JP) ..... 2012-081858
Jun. 20, 2012 (JP) ..... 2012-139255

(51) Int. Cl.
*E06B 9/303* (2006.01)
*E06B 9/384* (2006.01)

(52) U.S. Cl.
CPC ..... *E06B 9/303* (2013.01); *E06B 9/384* (2013.01); *Y10T 29/39* (2015.01)

(58) Field of Classification Search
CPC ..... E06B 9/303; E06B 9/322; E06B 9/382; E06B 9/384
(Continued)

(56) References Cited

U.S. PATENT DOCUMENTS 2,031,981 A * 2/1936 Runge ..... E06B 9/382 139/384 A
2,152,117 A * 3/1939 Wade ..... E06B 9/388 160/168.1 R
(Continued)

FOREIGN PATENT DOCUMENTS

JP 62-182398 11/1987
JP 2-5877 2/1990
(Continued)

OTHER PUBLICATIONS

International Search Report dated Jun. 25, 2013 from corresponding International Patent Application No. PCT/JP2013/059302; 2 pgs.

*Primary Examiner* — Katherine W Mitchell
*Assistant Examiner* — Abe Massad
(74) *Attorney, Agent, or Firm* — Maier & Maier, PLLC

(57) ABSTRACT

A weft of each rung of a ladder cord is formed of two weft threads, an intersecting portion is formed in the weft threads, a slat is inserted between the intersecting portion and one of warp threads of the ladder cord, and a lifting and lowering cord is inserted between the weft threads at a location between the intersecting portion and another of the warp threads.

3 Claims, 32 Drawing Sheets

(58) Field of Classification Search
USPC ..... 160/168.1 R, 178.3
See application file for complete search history.

(56) References Cited

U.S. PATENT DOCUMENTS

| | | | | | |
|---|---|---|---|---|---|
| 2,192,617 | A * | 3/1940 | North | E06B 9/382 | 160/170 |
| 2,275,273 | A * | 3/1942 | Taylor | E06B 9/382 | 160/178.3 |
| 2,583,031 | A * | 1/1952 | Walker | E06B 9/382 | 160/168.1 R |
| 2,587,756 | A * | 3/1952 | Palmisano | E06B 9/303 | 160/168.1 R |
| 2,620,865 | A * | 12/1952 | Isserstedt | E06B 9/386 | 160/173 R |
| 4,484,611 | A * | 11/1984 | Anderson | E06B 9/28 | 160/107 |
| 4,945,971 | A * | 8/1990 | Ivarsson | E06B 9/382 | 160/178.3 |
| 4,951,729 | A * | 8/1990 | Chi Yu | E06B 9/386 | 160/115 |
| 5,060,709 | A * | 10/1991 | Simon | E06B 9/305 | 160/168.1 R |
| 5,720,087 | A * | 2/1998 | Rasmussen | E06B 9/266 | 29/24.5 |
| 5,727,613 | A * | 3/1998 | Judkins | E06B 9/382 | 160/178.3 |
| 6,105,655 | A * | 8/2000 | Judkins | E06B 9/262 | 160/174 V |
| 6,179,035 | B1 * | 1/2001 | Anderson | E06B 9/303 | 160/168.1 R |
| 6,192,963 | B1 * | 2/2001 | Chen | E06B 9/303 | 160/168.1 R |
| 6,394,170 | B1 * | 5/2002 | Hsu | E06B 9/32 | 160/168.1 R |
| 7,556,080 | B2 * | 7/2009 | Nien | E06B 9/30 | 160/168.1 R |
| 8,807,194 | B2 * | 8/2014 | Shun | E06B 9/322 | 160/170 |
| 2013/0048233 | A1 * | 2/2013 | Lin | E06B 9/326 | 160/168.1 R |
| 2013/0068402 | A1 | 3/2013 | Shun et al. | | |
| 2015/0075728 | A1 * | 3/2015 | Tachikawa | E06B 9/384 | 160/168.1 R |

FOREIGN PATENT DOCUMENTS

| | | | | |
|---|---|---|---|---|
| JP | 7-6477 | | 1/1995 | |
| JP | 8-8233 | Y2 | 3/1996 | |
| JP | WO 2011138960 | A1 * | 11/2011 | E06B 9/322 |
| JP | 2011-252265 | A | 12/2011 | |

* cited by examiner

HORIZONTAL BLIND AND METHOD FOR MANUFACTURING HORIZONTAL BLIND

TECHNICAL FIELD

The present invention relates to a horizontal blind, in which a number of rungs of slats are suspended from a head box via ladder cords, and to a method of manufacturing a horizontal blind.

BACKGROUND

In a horizontal blind, a number of rungs of slats are supported by multiple ladder cords suspended from a head box, and all the slats can be operated to turn in the same phase through the ladder cords by operating a suspension apparatus for the ladder cords, which is disposed in the head box, with an operation apparatus.

A bottom rail is attached to lower ends of the ladder cords, and a lower end of a lifting/lowering cord suspended form the head box is attached to the bottom rail. Operating the operation apparatus causes a lifting/lowering apparatus disposed in the head box to lift or lower the lifting/lowering cord, which in turn lifts or lowers the bottom rail to lift or lower the slats.

In one type of such horizontal blinds, multiple lifting/lowering cords are suspended in front and back of the slats, without being inserted in the slats, for lifting or lowering the bottom rail.

In such a configuration, since it is not necessary to provide the slats with insertion holes for the lifting/lowering cords, no light leaks through the insertion holes.

Patent Document 1 discloses a horizontal blind in which lifting/lowering cords are not inserted in the slats, wherein each of the slats is inserted between weft threads of the ladder cords, the weft threads intersecting with each other, and a locking concavity of the slat is engaged with an intersecting portion of the weft threads so that misalignment of the slat in the longitudinal direction relative to the ladder cord is prevented.

Patent Document 2 discloses a horizontal blind in which a lifting/lowering cord is not inserted in the slats, wherein a lifting/lowering cord is inserted in a guide ring provided on the warp thread of a ladder cord. Further, it also discloses a configuration where two weft threads are supported in parallel to each other between warp threads and their positions in the vertical direction are interchanged to form intersecting portions at both sides of the weft threads, the slat is inserted between the intersecting portions, and the intersecting portions are engaged with notches of the slat so that misalignment of the slat in the longitudinal direction is prevented.

PRIOR ART DOCUMENTS

Patent Documents

Patent Document 1: Japanese Utility Model Application Publication No. H7-6477.

Patent Document 2: Japanese Unexamined Utility Model Application Publication No. S62-182398.

SUMMARY OF THE INVENTION

Problems to be Solved

Patent Document 1 does not disclose positional relationship of the lifting/lowering cord relative to the ladder cord.

If the lifting/lowering cord is not held by the ladder cord, the slats are layered tortuously in the right and left direction, i.e., in the longitudinal direction, in a lifting operation of the slats, which is aesthetically undesirable.

If the lifting/lowering cord is inserted in the guide ring provided on the warp thread of the ladder cord, as disclosed in the Patent Document 2, the lifting/lowering cord is held only loosely by the warp thread so that slats are layered tortuously in the right and left direction. If the lifting/lowering cord is inserted between the weft threads, friction occurs between the lifting/lowering cord and the notch of the slat, which makes the lifting/lowering cord wear easily and an operation force required in the lifting or lowering operation greater.

In the configuration where positions of two weft threads are interchanged in the vertical direction to form intersecting portions at both sides of the weft threads and the slat is inserted between the intersecting portions, it is difficult to mechanize a work step for inserting the slat between the weft threads, so that manual work is required, entailing an increase in production cost.

An object of the present invention is to provide a horizontal blind in which lateral misalignment of slats relative to ladder cords and tortuous layering of the slats occurring in a lifting operation can be prevented, friction between a lifting/lowering cord and the slats can be prevented, and further, assembling is facilitated and shielding performance is enhanced.

Means to Solve the Problems

According to an exemplary embodiment, a horizontal blind is provided which comprises a head box; multiple ladder cords suspended from the head box, each of the ladder cords having two warp threads and a weft provided between the two warp threads at each rung thereof; slats each supported by the weft at each rung of the ladder cords; and multiple lifting/lowering cords suspended from the head box, the slats being configured so as to be capable of being turned through the intermediary of the ladder cords and capable of being lifted or lowered by lifting or lowering the lifting/lowering cords, wherein the weft at each rung of the ladder cords is formed of multiple pieces of weft threads, at least one intersecting portion is formed in the weft threads, the slat is inserted among the intersecting portion and the weft threads, and the lifting/lowering cord is inserted between the weft threads at a location between the intersecting portion and the warp thread.

In an exemplary embodiment, the weft is formed of two weft threads which are formed on the warp threads in a state where they intersect with each other.

In an exemplary embodiment, a notch that engages with the weft thread is provided in a side edge of the slat on a side where the lifting/lowering cord is arranged.

In an exemplary embodiment, the following relationship exists: $W+(A/2)\geq S$, where W denotes a distance between the two warp threads, A denotes a distance between the two weft threads, and S denotes a width of the slat.

In an exemplary embodiment, the following relationship exists: $H1+H2\leq D$, where D denotes a depth of the notch provided in one side edge of the slat, H1 denotes a thickness of the lifting/lowering cord, and H2 denotes a thickness of the weft thread.

In an exemplary embodiment, the lifting/lowering cord inserted between the multiple pieces of weft threads at the location between the intersecting portion and the warp thread is inserted such that the multiple pieces of weft threads at the intersecting portion intersect with each other as seen from above.

In an exemplary embodiment, the intersecting portion is formed so as to be one-sided to the notch of the slat.

In an exemplary embodiment, the lifting/lowering cord is inserted between the weft threads every multiple rungs.

According to an exemplary embodiment, a method of manufacturing a horizontal blind is provided, the method comprising the steps of: forming two weft threads that intersect with each other into a weft of each rung of a ladder cord; expanding a space between an intersecting portion of the weft threads and one of warp threads of the ladder cord by means of a jig and inserting a slat in the space; and inserting a lifting/lowering cord between the weft threads at a location between the intersecting portion of the weft threads and another of the warp threads of the ladder cord.

In an exemplary embodiment, the jig is provided with multiple operation shafts corresponding one-to-one with the rungs of the ladder cord, each of the operation shafts expanding the space between the intersecting portion of the weft threads and the one of the warp threads of the ladder cord for inserting the slat in the space, and the space between the intersecting portion of the weft threads and the one of the warp threads of the ladder cord is expanded simultaneously for all rungs of the ladder cord by means of each of the operation shafts.

In an exemplary embodiment, insertion of the lifting/lowering cord between the weft threads at the location between the intersecting portion of the weft threads and another of the warp threads of the ladder cord is performed such that the two weft threads intersect with each other as seen from above.

In an exemplary embodiment, insertion of the lifting/lowering cord between the weft threads at the location between the intersecting portion of the weft threads and another of the warp threads of the ladder cord is performed such that the two weft threads do not intersect with each other as seen from above.

In an exemplary embodiment, right-side and left-side ladder cords for supporting right and left sides of the slats, respectively, are so configured that intersecting portions that engage with notches of the slats intersect such that directions of overlap of the weft threads in right and left direction are different between the right-side and left-side ladder cords, and insertion of the lifting/lowering cords at both right and left sides between the weft threads at the location between the intersecting portion of the weft threads and another of the warp threads of the ladder cord is performed such that the two weft threads do not intersect with each other as seen from above.

According to an exemplary embodiment, a method of manufacturing a horizontal blind is provided, wherein the intersecting portion is formed such that one of the weft threads is wound half or more around another of the weft threads and linked to the warp threads so that a state of intersection is not raveled.

Advantageous Effect of the Invention

According to the present invention, a horizontal blind can be provided in which lateral misalignment of slats relative to ladder cords and tortuous layering of the slats in a lifting operation are prevented, friction between a lifting/lowering cord and the slats can be prevented, and further, assembling is facilitated and shielding performance is good.

BEST MODE FOR CARRYING OUT THE INVENTION

First Embodiment

Figure 1:
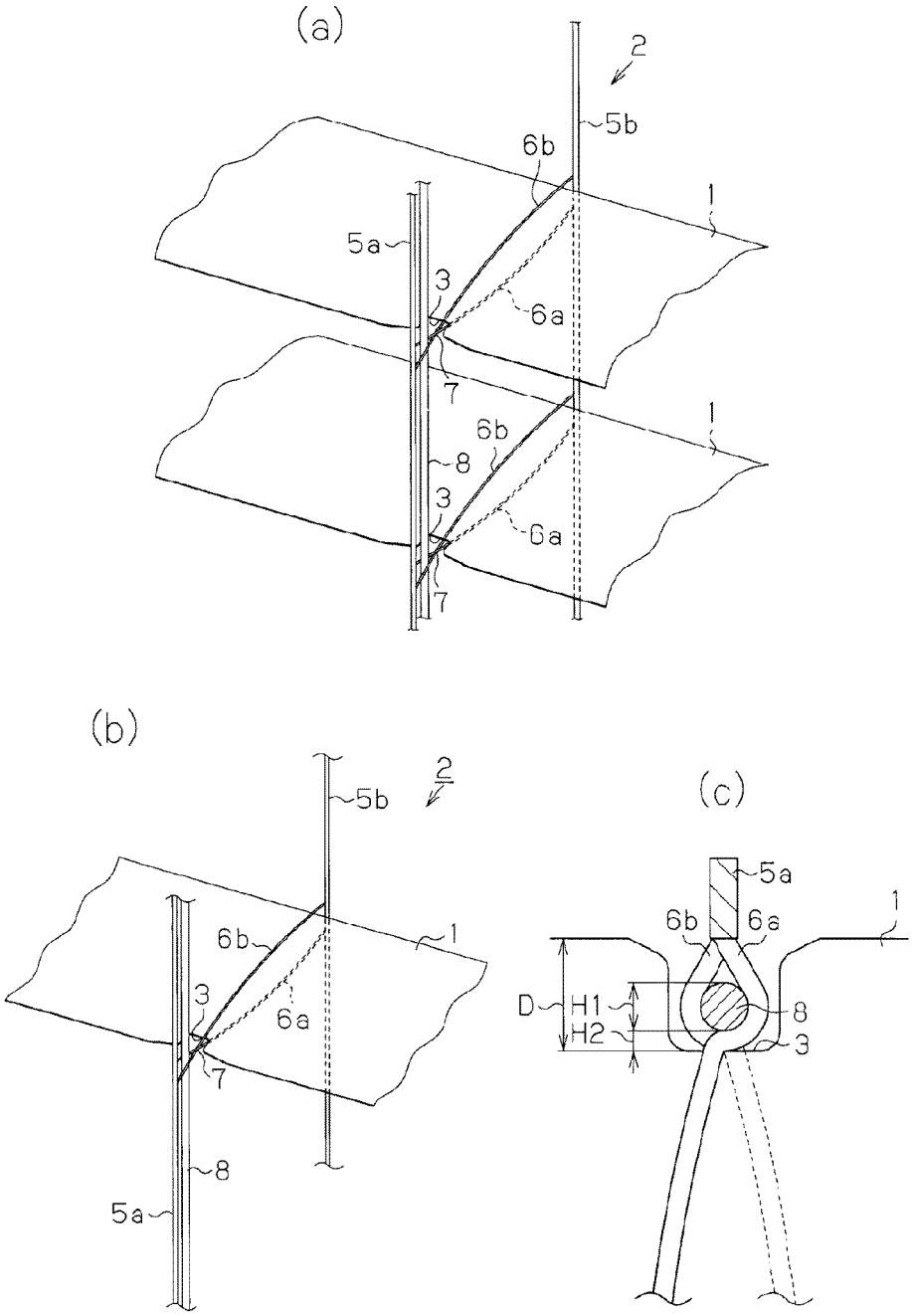
FIG. 1 is a view explaining a first embodiment, where (*a*) is a perspective view showing a slat-supporting section of a horizontal blind; (*b*) is a view showing a state in which a lifting/lowering cord is inserted; and (*c*) is a plan view explaining a relationship among the lifting/lowering cord, first and second weft threads and a notch of a slat.

Hereafter a first embodiment substantiating the present invention will be described according to the drawings. As shown in FIG. 1, a slat 1 of a horizontal blind is formed of a thin plate of aluminum, and has a notch 3 formed in one side edge in the width direction at a location supported by a ladder cord 2. The notch 3 is formed into a generally rectangular shape, and both sides of an opening thereof are cut off at a tilt to form a guiding portion.

As for the ladder cord 2, at least two are suspended from a head box (not shown) in order to support the slats 1, and, in this embodiment, four ladder cords 2 are suspended. In a space surrounded by a warp thread 5*a* and weft threads 6*a*, 6*b* seen in the side view shown in FIG. 1 (*a*), which is an enclosed space (closed space) surrounded by the weft threads 6*a*, 6*b* seen also in the plan view of FIG. 1 (*c*), a lifting/lowering cord 8 is inserted.

Figure 2:
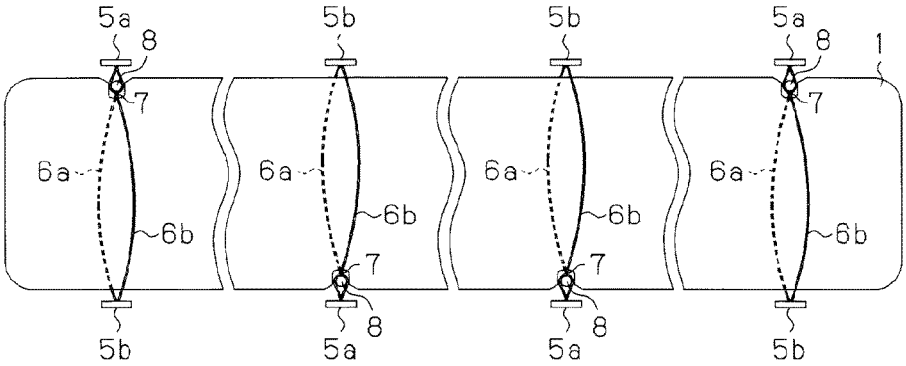
FIG. 2 is a plan view showing the slat-supporting section of the horizontal blind.

As shown in FIG. 2, the notch 3 is provided in each of the slats 1 at the location supported by the ladder cord 2.

The ladder cord 2 is provided with a pair of warp threads 5*a*, 5*b* and a number of vertical rungs of weft threads arranged between the warp threads 5*a*, 5*b*, each rung of the weft threads including two weft threads 6*a*, 6*b* for supporting one slat 1.

Figure 3:
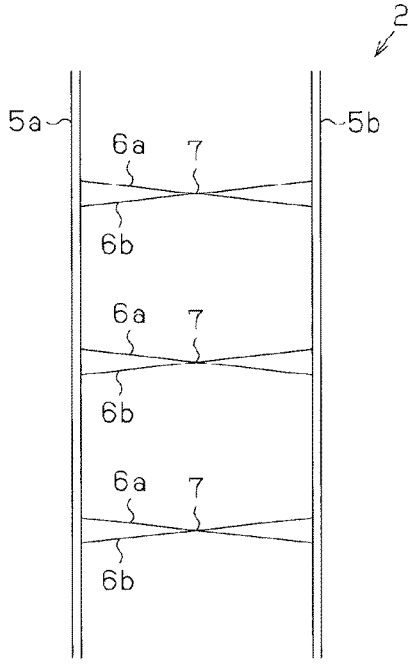
FIG. 3 is a front view showing a ladder cord.

As shown in FIG. 3, the weft threads 6*a*, 6*b* are formed on the one warp thread 5*a* such that an end of the weft thread 6*a* is located above an end of the weft thread 6*b*, and on the other warp thread 5*b* such that an end of the weft thread 6*b* is located above an end of the weft thread 6*a*. Thus, the weft threads 6*a*, 6*b* is provided with an intersecting portion 7 where they intersect with each other midway therein.

The slat 1 is inserted between the intersecting portion 7 and the other warp thread 5*b* such that the intersecting portion 7 of the weft threads 6*a*, 6*b* is located within the notch 3.

As shown in FIGS. 1 and 2, the lifting/lowering cord 8, which is for lifting and lowering the slat 1, is inserted between the weft threads 6*a*, 6*b* at a location between the intersecting portion 7 located within the notch 3 and the one warp thread 5*a*. Therefore, at both sides in the longitudinal direction of the slat 1, the lifting/lowering cords 8 are on a side of the slat 1 oriented to the interior of the room, for example, while at middle positions in the longitudinal direction of the slat 1, the lifting/lowering cords 8 are on a side of the slat 1 oriented to the exterior of the room, and a bottom rail is attached to the lower end of each of the lifting/lowering cords 8.

Figure 7:
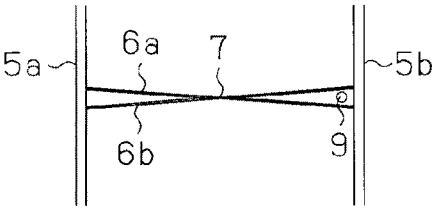
FIG. 7 is a front view showing an attaching process of the slat.
Figure 8:
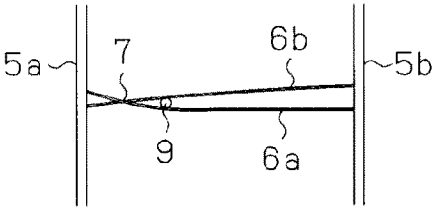
FIG. 8 is a front view showing the attaching process of the slat.

In combining the slats 1 and the lifting/lowering cords 8 with the ladder cords 2 configured as described above, as shown in FIG. 7, an operation shaft 9 of a thin rod shape is inserted between the intersecting portion 7 of the weft threads 6*a*, 6*b* and the warp thread 5*b* of the ladder cord 2. Then, as shown in FIG. 8, the operation shaft 9 is slid toward the warp thread 5*a* to secure a space enabling insertion of the slat 1 between the intersecting portion 7 and the warp thread 5*b*.

Figure 9:
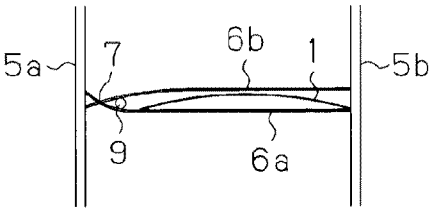
FIG. 9 is a front view showing the attaching process of the slat.

Next, as shown in FIG. 9, the slat 1 is inserted between the weft threads 6*a*, 6*b* at the location between the intersecting portion 7 and the warp thread 5*b*.

Figure 10:
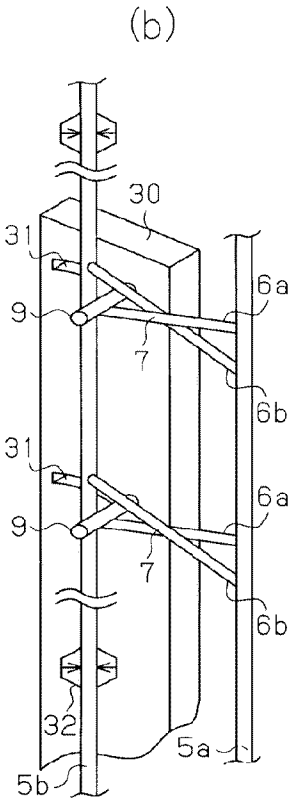
FIGS. 10 (*a*) and (*b*) are perspective views showing an attaching process of the slat to the ladder cord.
Figure 10:
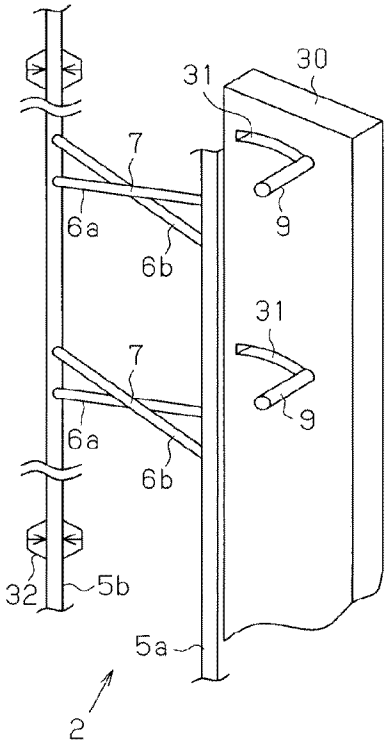

In more detail, as shown in FIG. 10 (*a*), a jig 30 is used for inserting the slat 1 between the intersecting portion 7 of the weft threads 6*a*, 6*b* and the one warp thread 5*b*. The jig 30 is provided with insertion holes 31 which are configured such that not only a number of the operation shafts 9 protrude therethrough at regular intervals so as to be capable of being inserted between the weft threads 6*a*, 6*b* of each rung, but also the slats 1 are inserted therethrough.

While the one warp thread 5*b* of the ladder cord 2 is held by a holding apparatus 32, the operation shafts 9 are each inserted between the weft threads 6*a*, 6*b*, as shown in FIG. 10 (*b*).

Figure 11:
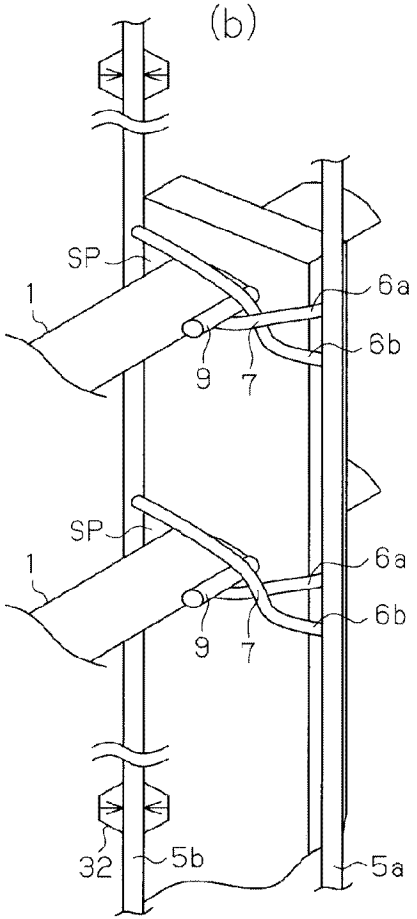
FIGS. 11 (*a*) and (*b*) are perspective views showing the attaching process of the slat to the ladder cord.
Figure 11:
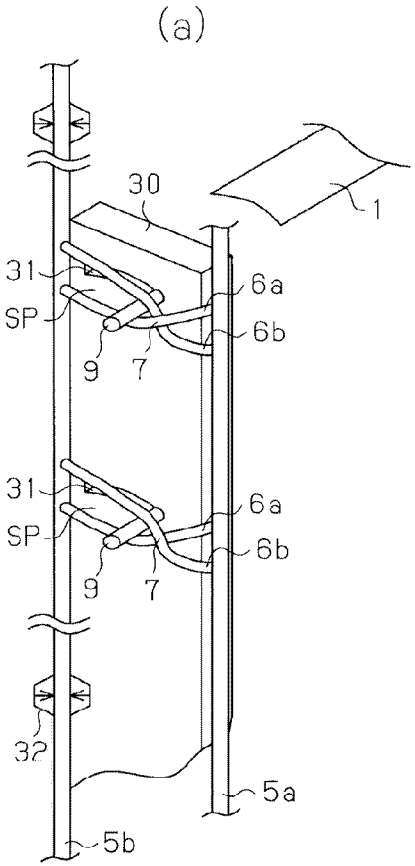

Next, as shown in FIG. 11 (*a*), the jig 30 is shifted toward the warp thread 5*a*, causing the intersecting portion 7 to be shifted by the operation shaft 9 toward the warp thread 5*a*, and thus making the distance between the intersecting portion 7 and the warp thread 5*b* greater than the width of the slat 1, which results in formation of a slat-inserting space SP.

Next, as shown in FIG. 11 (*b*), the slat 1 is inserted through the insertion hole 31 of the jig 30, and, as a result, the slat 1 is inserted in the slat-inserting space SP. Thereafter, the jig 30 is detached from the ladder cord 2, and thus, the insertion process of the slat 1 into the ladder cord 2 using the jig 30 is completed.

Figure 5:
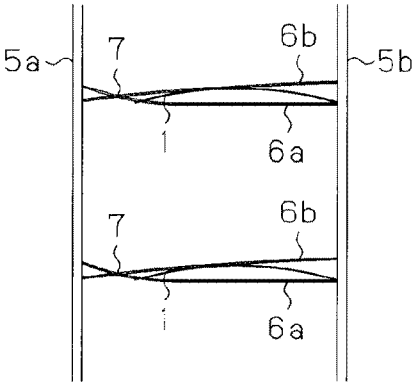
FIG. 5 is a front view showing the ladder cord in which the slat is inserted.

Next, as shown in FIG. 5, the operation shaft 9 between the weft threads 6*a*, 6*b* is pulled out. Then, the lifting/lowering cord 8 is inserted in the space surrounded by the intersecting portion 7, the warp thread 5*a* and the weft threads 6*a*, 6*b*. Thus, the combining process of the slats 1 and the lifting/lowering cords 8 with the ladder cords 2 is completed.

Thereafter, the upper ends of the warp threads 5*a*, 5*b* of the ladder cord 2 are attached to a ladder cord-supporting apparatus within the head box, and the lower ends of the warp threads 5*a*, 5*b* of the ladder cord 2 are attached to the bottom rail. Then, the upper end of the lifting/lowering cord 8 is attached to a lifting/lowering apparatus within the head box and the lower end of the lifting/lowering cord 8 is attached to the bottom rail. It is possible to insert the slat 1, unlike the Patent Document 1, without expanding a gap between the intersecting portion and the warp thread by means of an end portion of the slat.

Next, the working of the horizontal blind having the above configuration will be described. When the lifting/lowering cord 8 suspended from the head box is lifted by an operation of an operation apparatus, the bottom rail is lifted so that the slats 1 are lifted in a state where the slats 1 are layered sequentially, with the slat of the lowermost rung first, on the bottom rail.

Also, when the lifting/lowering cord 8 is lowered by an operation of the operation apparatus, the bottom rail is lowered so that the slats 1 are restored sequentially, with the slat of the uppermost rung first, to a state where they are supported by the ladder cord 2.

When one of the warp threads of the ladder cord 2 is lifted by an operation of the operation apparatus through the ladder cord-supporting apparatus, the slats 1 are turned in a direction leading to a fully-closed state or in a direction leading to a contrariwise fully-closed state.

In such a lifting or lowering operation of the slats 1, lateral misalignment of the slats 1, i.e., misalignment of the slats 1 in position in the longitudinal direction, is blocked, since the intersecting portions 7 of the weft threads 6*a*, 6*b* are in engagement with the notches 3 of the slats 1.

The weft threads 6*a*, 6*b* and the intersecting portion 7 are interposed between the lifting/lowering cord 8 and an edge of the notch 3, so that the lifting/lowering cord 8 does not touch the edge of the notch 3 directly. Therefore, increase in the operation force due to friction between the lifting/lowering cord 8 and the edge is prevented, and further, wear of the lifting/lowering cord 8 resulting from repeated operations for lifting or lowering the slats is suppressed.

Moreover, since the lifting/lowering cord 8 is inserted in the space surrounded by the weft threads 6*a*, 6*b*, the intersecting portion 7 and the warp thread 5*a*, fluctuation in the suspending position of the ladder cord 2 is restricted by the lifting/lowering cord 8, and thus, it is possible to prevent tortuous layering of the slats 1 on the bottom rail from occurring in the lifting operation of the slats 1.

Figure 12:
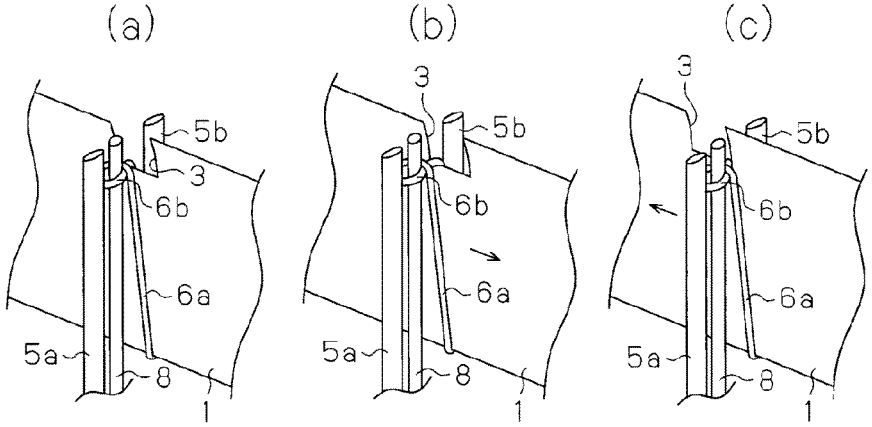
FIG. 12 (*a*) is a view showing an engagement state of a weft thread of the ladder cord and the notch when the slat is in a fully-closed state; (*b*) is a view showing an engagement state of a second weft thread of the ladder cord and the notch when the slat is in the fully-closed state; and (*c*) is a view showing an engagement state of the ladder cord and the notch when the slat is in the fully-closed state.

Furthermore, as shown in FIGS. 12 (*a*)-(*c*), the lifting/lowering cord 8 is inserted in the space formed by the weft thread 6*a*, the weft thread 6*b* and the warp thread 5*a*, the space being between the warp thread 5*a* and the intersecting portion 7 at which the weft thread 6*a* intersects with the weft thread 6*b* from the right side. Here, the lifting/lowering cord 8 is inserted such that the weft thread 6*a* is disposed on the right side and the weft thread 6*b* is disposed on the left side as seen from above.

Due to this arrangement, even if the slat 1 is urged to move in the direction indicated by the arrow in FIG. 12 (*b*), lateral misalignment of the slat 1 in the direction shown by the arrow is restricted by the weft thread 6*b*. In contrast, even if the slat 1 is urged to move in the direction indicated by the arrow in FIG. 12 (*c*), lateral misalignment of the slat 1 in the direction shown by the arrow is restricted by the lifting/lowering cord 8.

Figure 4:
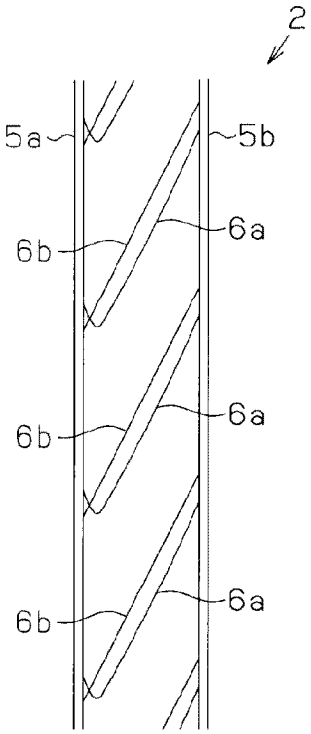
FIG. 4 is a front view showing the ladder cord.
Figure 6:
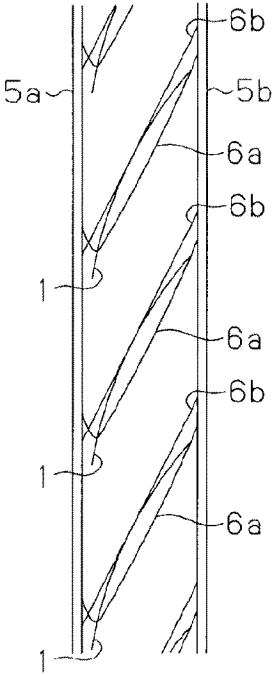
FIG. 6 is a front view showing the ladder cord in which the slat is inserted.

As shown in FIG. 4, when the warp thread 5*b* is moved upward and the warp thread 5*a* is moved downward in a turning operation of the slat 1, though the weft thread 6*a* located on a side of the lower surface of the slat 1 is loosened a little, the weft thread 6*b* located on a side of the upper surface of the slat 1 is tightened. As a result, as shown in FIG. 6, the upper surface of the slat 1 is pressed by the weft thread 6*b* in the turning operation of the slat 1, so that the slat 1 is turned certainly into the fully-closed state in which the slat is in the vertical direction, i.e., the convex surface thereof is oriented to the exterior of the room.

Figure 13:
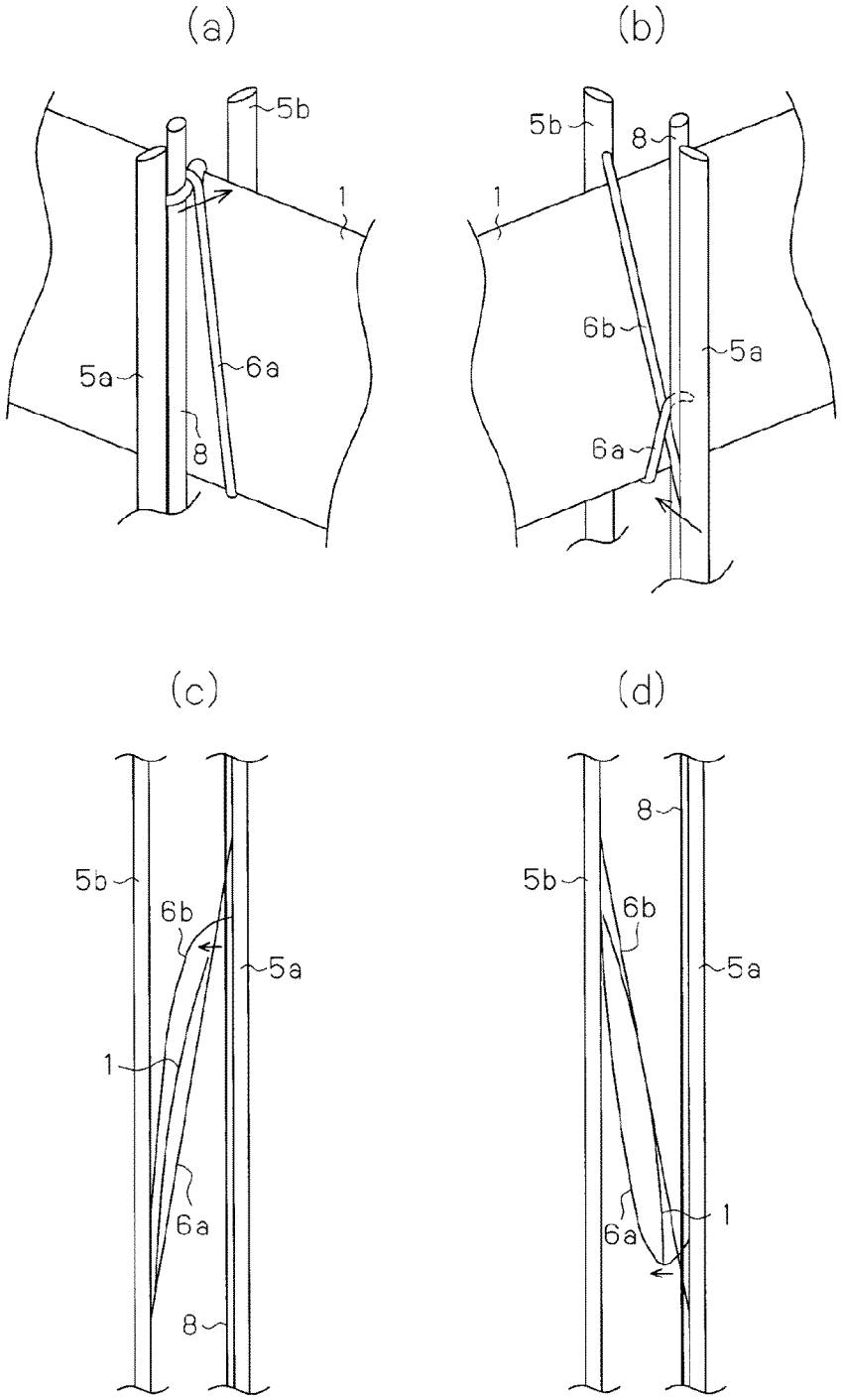
FIG. 13 (*a*) is a perspective view explaining a working of the lifting/lowering cord when the slat is in the fully-closed state; (*b*) is a perspective view explaining a working of the lifting/lowering cord when the slat is in a contrariwise fully-closed state; (*c*) is a side view explaining the working of the lifting/lowering cord when the slat is in the fully-closed state; and (*d*) is a side view explaining the working of the lifting/lowering cord when the slat is in the contrariwise fully-closed state.

At this time, since the lifting/lowering cord 8 is disposed inside of the warp threads 5*a*, 5*b*, a pressing force is applied to the slat 1 in the direction indicated by the arrows in FIGS. 13 (*a*) and 13 (*c*) through the weft threads 6*a*, 6*b* intersecting with each other as seen from above, which has an effect of increasing shielding performance in the fully-closed state.

Further, also in the contrariwise fully-closed state, a pressing force is applied to the slat 1 in the direction indicated by the arrows in FIGS. 13 (*b*) and 13 (*d*) through the weft threads 6*a*, 6*b* intersecting with each other as seen from above, which has an effect of increasing shielding performance in the contrariwise fully-closed state.

Note that the notch is omitted in FIGS. 13 (*a*) and 13 (*b*) as a matter of convenience for explanation.

According to the horizontal blind configured as described above, the following effects can be obtained.

(1) Since the intersecting portion 7 of the weft threads 6*a*, 6*b* is in engagement with the notch 3 of the slat 1, it is possible to bock misalignment of the slat 1 in position in the longitudinal direction. Especially, even in the case where the slat 1 is turned such that the notch 3 is at the upper edge thereof, misalignment does not occur, since engagement of the intersecting portion 7 with the notch 3 is facilitated.

(2) Since the slat 1 is inserted between the weft threads 6*a*, 6*b* at the location between the intersecting portion 7 of the weft threads 6*a*, 6*b* and the warp thread 5*b* and the lifting/lowering cord 8 is inserted between the weft threads 6*a*, 6*b* at the location between the intersecting portion 7 and the warp thread 5*a*, it is possible to prevent tortuous layering of the slats 1 on the bottom rail, in the right and left direction, i.e., the longitudinal direction, from occurring in the lifting operation of the slats.

(3) Since the weft threads 6*a*, 6*b* are interposed between the lifting/lowering cord 8 and the edge of the notch 3, it is possible to suppress wear of the lifting/lowering cord 8 and to reduce the operation force required in the lifting or lowering operation.

(4) In the turning operation of the slat 1, the weft thread 6*b* touching the upper surface of the slat 1 is tightened and the weft thread 6*a* supporting the lower surface of the slat 1 is loosened, so that the slat 1 can be turned easily into a substantially vertical direction when setting the slat 1 in the fully-closed state. Therefore, it is possible to enhance light-shielding performance when the slat is in the fully-closed state.

(5) The slat 1 can be inserted while the distance between the intersecting portion 7 of the weft threads 6*a*, 6*b* and the warp thread 5*b* is expanded by the operation shaft 9, so that it is possible to mechanize the insertion process of the slat 1 in the ladder cord 2, and thus, production cost is lowered.

The first embodiment described above may be implemented in the following manner.

- In the first embodiment, it is not necessary to insert the lifting/lowering cord 8 between the weft threads 6*a*, 6*b* in all of the rungs among a number of rungs of the weft threads 6*a*, 6*b*, but the lifting/lowering cord 8 may be inserted, for example, at only one rung among five rungs of the weft threads 6*a*, 6*b* which are successive in the vertical direction.
- In the first embodiment, the lifting/lowering cord may be suspended only either in front or in back of the slats, and the bottom rail may be attached to the lower end of that lifting/lowering cord.

Second Embodiment

Figure 14:
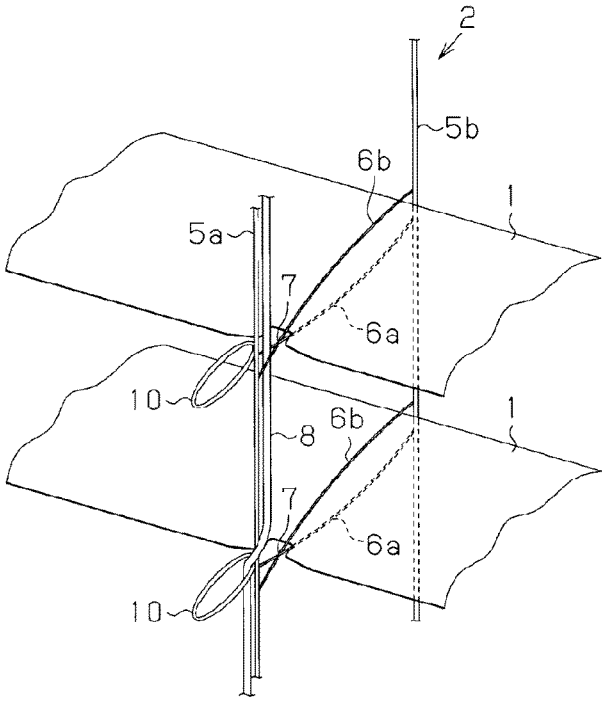
FIG. 14 is a perspective view showing a second embodiment.

FIG. 14 shows a second embodiment. In this embodiment, the warp thread 5*a* of the ladder cord 2 is provided with guide rings 10 in the vicinities of attachment positions of the weft threads 6*a*, 6*b*. The lifting/lowering cord 8 is inserted alternately between the intersecting portion 7 of the weft threads 6*a*, 6*b* and the warp thread 5*a* and in the guide ring 10, every other pitch of the weft threads 6*a*, 6*b*.

According to the horizontal blind of this embodiment, the following effect can be obtained in addition to those obtained in the first embodiment.

Since the lifting/lowering cord 8 is inserted in the guide ring 10 every other pitch of the weft threads 6*a*, 6*b*, friction between the lifting/lowering cord 8 and the weft threads 6*a*, 6*b* can be reduced. Therefore, the operation force required in the operation for lifting or lowering the slats 1 is further reduced compared to the first embodiment.

The second embodiment described above may be implemented in the following manner.

- In the second embodiment, it is not necessary to insert the lifting/lowering cord 8 between the weft threads 6*a*, 6*b* in all of the rungs among a number of rungs of the weft threads 6*a*, 6*b*, but the lifting/lowering cord 8 may be inserted, for example, at only one rung among five rungs of the weft threads 6*a*, 6*b* which are successive in the vertical direction.
- While, in the second embodiment, the lifting/lowering cord 8 is inserted alternately in the guide ring 10 and between the intersecting portion 7 of the weft threads 6*a*, 6*b* and the warp thread 5*a*, inserting the lifting/lowering cord 8 between the intersecting portion 7 of the weft threads 6*a*, 6*b* and the warp thread 5*a* every three or four pitches will further reduce the friction between the lifting/lowering cord 8 and the weft threads 6*a*, 6*b*.
- In the second embodiment, the lifting/lowering cord may be suspended only either in front or in back of the slats, and the bottom rail may be attached to the lower end of that lifting/lowering cord.

Third Embodiment

Figure 15:
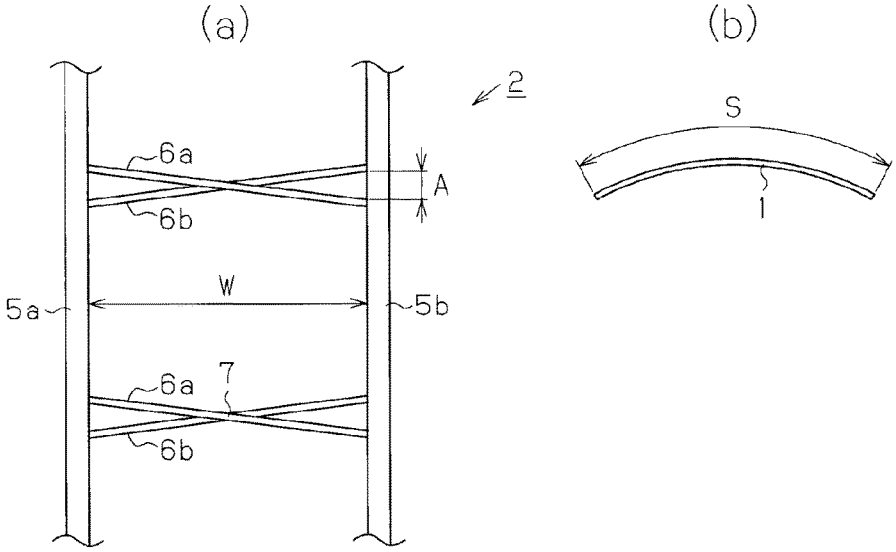
FIG. 15 is a view showing a third embodiment, where (*a*) is a side view explaining a relationship between first and second warp threads and first and second weft threads of the ladder cord; and (*b*) is a side view explaining a width of the slat.

FIG. 15 shows a third embodiment. In this embodiment, the distance between the weft threads 6*a*, 6*b* as well as the distance between the warp threads 5*a*, 5*b* of the ladder cord 2 shown in the first embodiment are specified in relation to the width of the slat 1.

As shown in FIG. 15 (*a*), in the ladder cord 2, a first weft thread 6*a* is formed on a first warp thread 5*a* so as to be located above a second weft thread 6*b*. Further, the second weft thread 6*b* is formed on a second warp thread 5*b* so as to be located above the first weft thread 6*a*.

In this situation, the distance between the first weft thread 6*a* and the second weft thread 6*b* in the vertical direction is defined as distance A.

Also, as shown in the figure, the distance between the first warp thread 5*a* and the second warp thread 5*b* is defined as distance W, and the width (length in the lateral direction) of the slat 1 is defined as S, as shown in FIG. 15 (*b*), and they are set such that the following relationship exists:

$$W+(A/2)\geq S.$$

Due to this relationship, it is possible to slide the intersecting portion 7 toward the first warp thread 5*a* by means of the operation shaft 9 for inserting the slat 1 (see FIG. 5), securing a space between the intersecting portion 7 and the second warp thread 5*b*, in which space the slat 1 can be inserted. As a result, it is possible to insert the slat 1 easily between the first and second weft threads 6*a*, 6*b* at the location between the intersecting portion 7 and the second warp thread 5*b*.

Further, as shown in FIGS. 1 (*a*) and 1 (*b*), the intersecting portion 7 of the first and second weft threads 6*a*, 6*b* is engaged with the notch 3 of the slat 1. At the location between that intersecting portion 7 and the second warp thread 5*b*, the slat 1 is inserted between the first and second weft threads 6*a*, 6*b*, and at the location between that intersecting portion 7 and the first warp thread 5*a*, the lifting/lowering cord 8 is inserted in the space between the first and second weft threads 6*a*, 6*b*.

As shown in FIG. 1 (*c*), similarly to the first embodiment, the notch 3 is formed into a generally rectangular shape, and the depth D of the notch 3, which has guide portions formed at both sides of an opening thereof, is set in this embodiment such that the following relationship exists:

$$H1+H2\leq D$$

where H1 is a thickness of the lifting/lowering cord 8 and H2 is a thickness of the first and second weft threads 6*a*, 6*b*.

Due to this relationship, it is possible to interpose the lifting/lowering cord 8 and the intersecting portion 7 within the notch 3, making it possible to more certainly prevent tortuous layering of the slats 1 on the bottom rail, in the right and left direction, i.e., the longitudinal direction, from occurring in the lifting operation of the slats.

Thus, in this embodiment, the following effects can be obtained, in addition to those of the first embodiment: it is possible to insert the slat 1 certainly in the space formed between the first and second weft threads 6*a*, 6*b* at the location between the intersecting portion 7 and the second warp thread 5*b*, and to prevent tortuous layering of the slats 1 in the longitudinal direction in the lifting operation of the slats.

Fourth Embodiment

Figure 16:
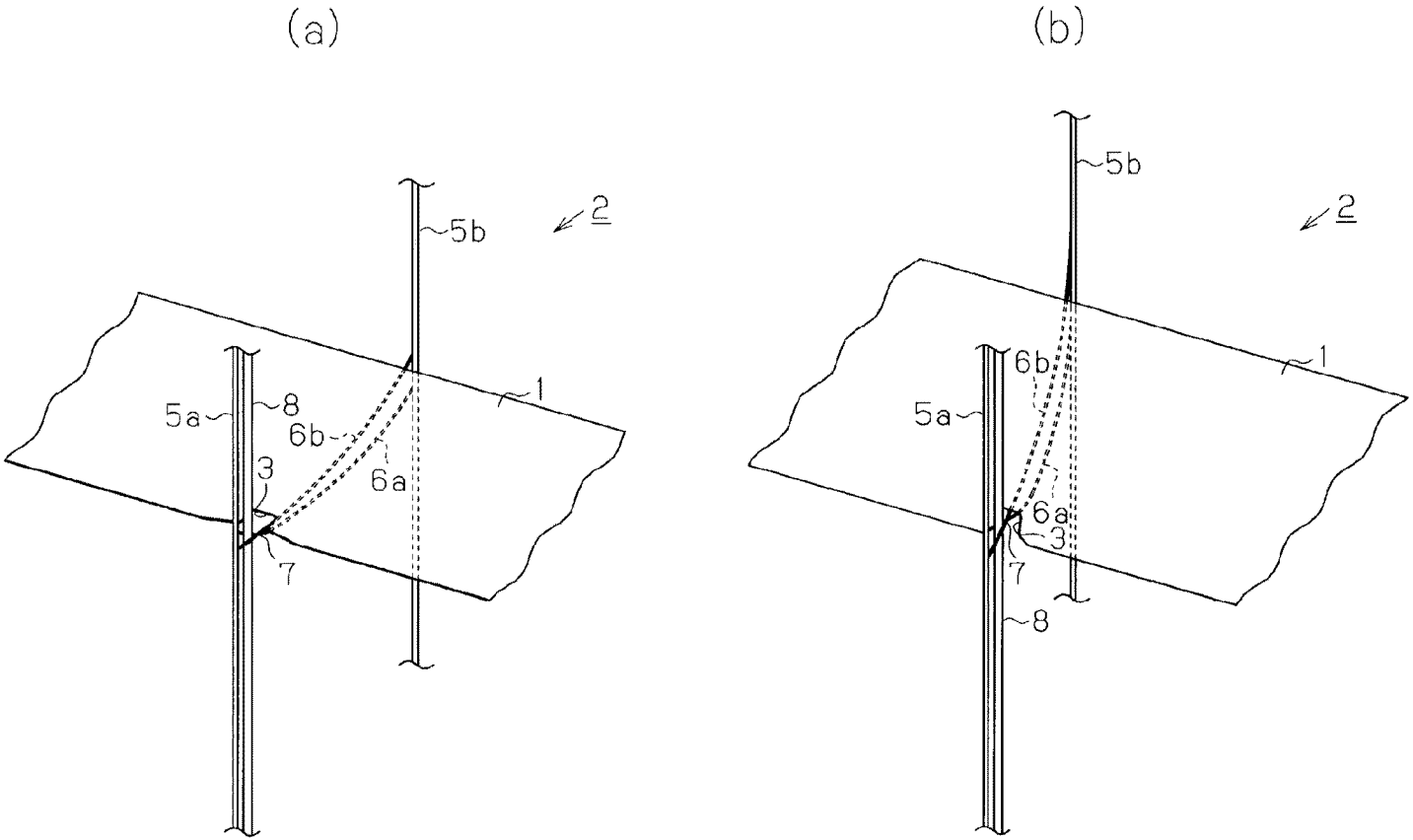
FIG. 16 is a view explaining a fourth embodiment, where (*a*) is a perspective view of a principal part showing a state in which the slat is supported horizontally; and (*b*) is a perspective view of the principal part showing a state in which the slat is supported in the fully-closed state.

FIGS. 16 (*a*) and 16 (*b*) show a fourth embodiment.

As shown in FIG. 16 (*a*), in the ladder cords 2 at both right and left sides, the end of the first weft thread 6*a* is formed on the first warp thread 5*a* so as to be located above the end of the second weft thread 6*b*, and the end of the second weft thread 6*b* is formed on the second warp thread 5*b* opposite to the first warp thread 5*a* so as to be located above the end of the first weft thread 6*a*. Thus, at the location between the first warp thread 5*a* and the second warp thread 5*b*, the intersecting portion 7 is formed where the first weft thread 6*a* and the second weft thread 6*b* intersect with each other.

In this embodiment, the intersecting portion 7 supports the slat 1 by the first and second weft threads 6*a*, 6*b*, as shown in FIGS. 16 (*a*) and 16 (*b*). The intersecting portion 7 of the ladder cord 2 is one-sided to the first warp thread 5*a*. This one-sided positioning is achieved by locating the intersecting portion 7 closer to the first warp thread 5*a* through heat-setting at the time of manufacturing the ladder cord 2.

With respect to the ladder cord 2 thus manufactured, the slat 1 is placed on the first weft thread 6*a* and the second weft thread 6*b* whose intersecting portion 7 is one-sided to the first warp thread 5*a*, at the location between the first warp thread 5*a* and the second warp thread 5*b*.

Further, the lifting/lowering cord 8 is inserted in a space formed between the first weft thread 6*a* and the second weft thread 6*b* at the location between the first warp thread 5*a* and the one-sided intersecting portion 7, at the location of the notch 3.

Therefore, both right and left sides of the slat 1 is disposed on the first weft thread 6*a* and the second weft thread 6*b* intersecting with each other. Further, when the slat 1 is in a horizontal attitude, the intersecting portion 7 is located closer to the first warp thread 5*a* as shown in FIG. 16 (*a*), and when fully closed, the intersecting portion 7 is located closer to the notch 3 as shown in FIG. 16 (*b*).

Note that, as to the supporting structure for the slat thus configured, it is preferable that, in a horizontal blind composed of multiple rungs of slats, a predetermined number of upper slats or less are implemented by the supporting structure of this embodiment.

As described above, also in this embodiment, it is possible to block misalignment of the slat 1 in position in the longitudinal direction, and to prevent tortuous layering of the slats 1 in the longitudinal direction in the lifting operation of the slats. Further, since the first and the second weft threads 6*a*, 6*b* are interposed between the lifting/lowering cord 8 and the edge of the notch 3, it is possible to suppress wear of the lifting/lowering cord 8, and to reduce the operation force required in the lifting or lowering operation.

Fifth Embodiment

FIGS. 17 to 20 show a fifth embodiment.

Figure 17:
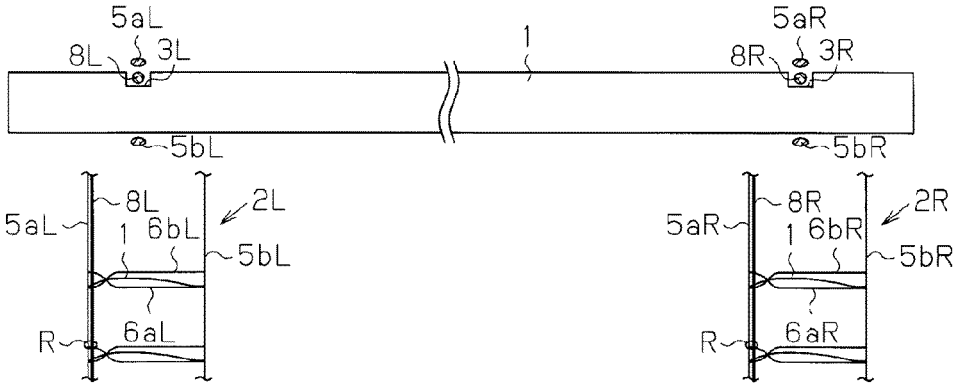
FIG. 17 is a view showing the slat and the ladder cord for explaining a fifth embodiment.

FIG. 17 is a view explaining a relationship between the slats 1 and the ladder cords 2 provided on the right and left sides of the slats 1 and the lifting/lowering cords 8 provided on the right and left sides.

As shown in FIG. 17, the left side of the slat 1 is supported by a left-side ladder cord 2L, and the right side of the slat 1 is supported by a right-side ladder cord 2R. The slat 1 is provided, at both the right and left sides of one side edge, with a left-side notch 3L formed in the width direction at a location supported by the left-side ladder cord 2L, and with a right-side notch 3R formed in the width direction at a location supported by the right-side ladder cord 2R.

Figure 18:
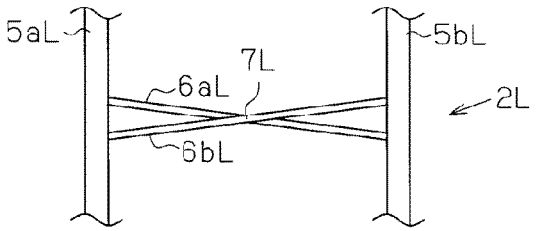
FIG. 18 is a view showing an intersecting state of the first and second weft threads of a left-side ladder cord.

As shown in FIG. 18, on a left-side first warp thread 5*a*L of the left-side ladder cord 2L, an end of a left-side first weft thread 6*a*L is formed so as to be located above an end of a left-side second weft thread 6*b*L. Also, on a left-side second warp thread 5*b*L, an end of a left-side second weft thread 6*b*L is formed so as to be located above an end of a left-side first weft thread 6*a*L. That is, the left-side first and left-side second weft threads 6*a*L, 6*b*L are formed between the left-side first warp thread 5*a*L and the left-side second warp thread 5*b*L so as to intersect with each other.

Figure 20:
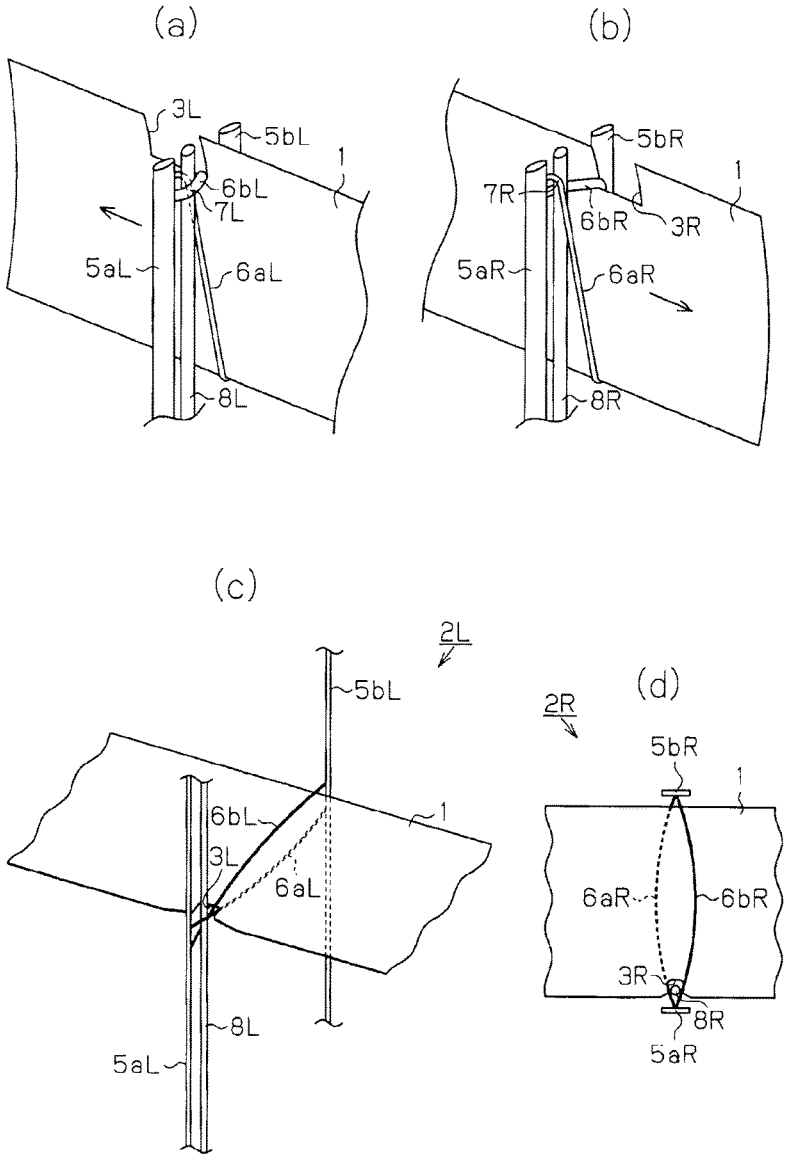
FIG. 20 (*a*) is a view showing an intersecting state of the first and second weft threads of the left-side ladder cord when the slat is in the fully-closed state; (*b*) is a view showing an intersecting state of the first and second weft threads of the right-side ladder cord when the slat is in the fully-closed state; and (*c*) and (*d*) are views showing a manner of inserting a left-side lifting/lowering cord.

Here, as shown in FIGS. 20 (*a*), 20 (*c*) and 20 (*d*), the left-side first and left-side second weft threads 6*a*L, 6*b*L intersecting with each other are arranged such that, at a left-side intersecting portion 7L thereof, the left-side first weft thread 6a L is located on a left side of the left-side second weft thread 6b L as seen in FIG. 20 (*a*).

Figure 19:
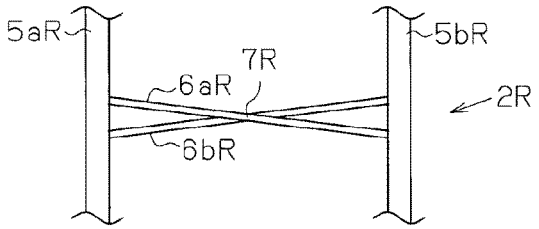
FIG. 19 is a view showing an intersecting state of the first and second weft threads of a right-side ladder cord.

Meanwhile, as shown in FIG. 19, on a right-side first warp thread 5a R of the right-side ladder cord 2R, an end of a right-side first weft thread 6a R is formed so as to be located above an end of a right-side second weft thread 6b R. Also, on a right-side second warp thread 5b R, an end of a right-side second weft thread 6b R is formed so as to be located above an end of a right-side first weft thread 6a R. That is, the right-side first and right-side second weft threads 6a R, 6b R are formed between the right-side first warp thread 5a R and the right-side second warp thread 5b R so as to intersect with each other.

Here, the right-side first and right-side second weft threads 6a R, 6b R are arranged to intersect with each other, unlike in the left-side ladder cord 2L, such that, at a right-side intersecting portion 7R thereof, the right-side first weft thread 6a R is located on a right side of the right-side second weft thread 6b R as seen in FIG. 20 (*b*).

That is, as shown in FIGS. 20 (*a*) and 20 (*b*), in the left-side ladder cord 2L, the left-side first weft thread 6a L intersects with the left-side second weft thread 6b L while passing on the left side of the second weft thread 6b L, while, in the right-side ladder cord 2R, the right-side first weft thread 6a R intersects with the right-side second weft thread 6b R while passing on the right side of the second weft thread 6b R, as seen in FIG. 20 (*b*).

The slat 1 is inserted between the left-side and right-side first weft threads 6a L, 6a R and the left-side and right-side second weft threads 6b L, 6b R such that the left-side intersecting portion 7L is located in the left-side notch 3L and the right-side intersecting portion 7R is located in the right-side notch 3R.

Further, as shown in FIG. 18, the left-side lifting/lowering cord 8L is inserted in a space formed between the left-side first weft thread 6a L and the left-side second weft thread 6b L at a location between the left-side intersecting portion 7L located in the left-side notch 3L and the left-side first warp thread 5a L. That is, as shown in FIGS. 20 (*a*) and 20 (*c*), the lifting/lowering cord 8L disposed inside the warp threads 5a L, 5b L is in a state where the weft threads 6a L, 6b L do not intersect as seen from above. Also, as shown in FIG. 19, the right-side lifting/lowering cord 8R is inserted in a space formed between the right-side first weft thread 6a R and the right-side second weft thread 6b R at a location between the right-side intersecting portion 7R located in the right-side notch 3R and the right-side first warp thread 5a R. That is, as shown in FIGS. 20 (*b*) and 20 (*d*), the lifting/lowering cord 8R disposed inside the warp threads 5a R, 5b R is in a state where the weft threads 6a R, 6b R do not intersect as seen from above.

Due to the above configuration, this embodiment has the following effects.

Since, in the left-side ladder cord 2L, the left-side first weft thread 6a L is configured to intersect with the left-side second weft thread 6b L on the left side of the second weft thread 6b L, even if the slat 1 is urged to move leftward as shown in FIG. 20 (*a*), the left-side second weft thread 6b L engages with the left-side notch 3L and this state is maintained by the lifting/lowering cord 8L, which makes it possible to restrict the lateral misalignment of the slat 1 in the leftward direction.

On the other hand, in the right-side ladder cord 2R, the right-side first weft thread 6a R is configured to intersect with the right-side second weft thread 6b R on the right side of the second weft thread 6b R, even if the slat 1 is urged to move rightward as shown in FIG. 20 (*b*), the right-side second weft thread 6b R engages with the right-side notch 3R and this state is maintained by the lifting/lowering cord 8R, which makes it possible to restrict the lateral misalignment of the slat 1 in the rightward direction.

Sixth Embodiment

Figure 21:
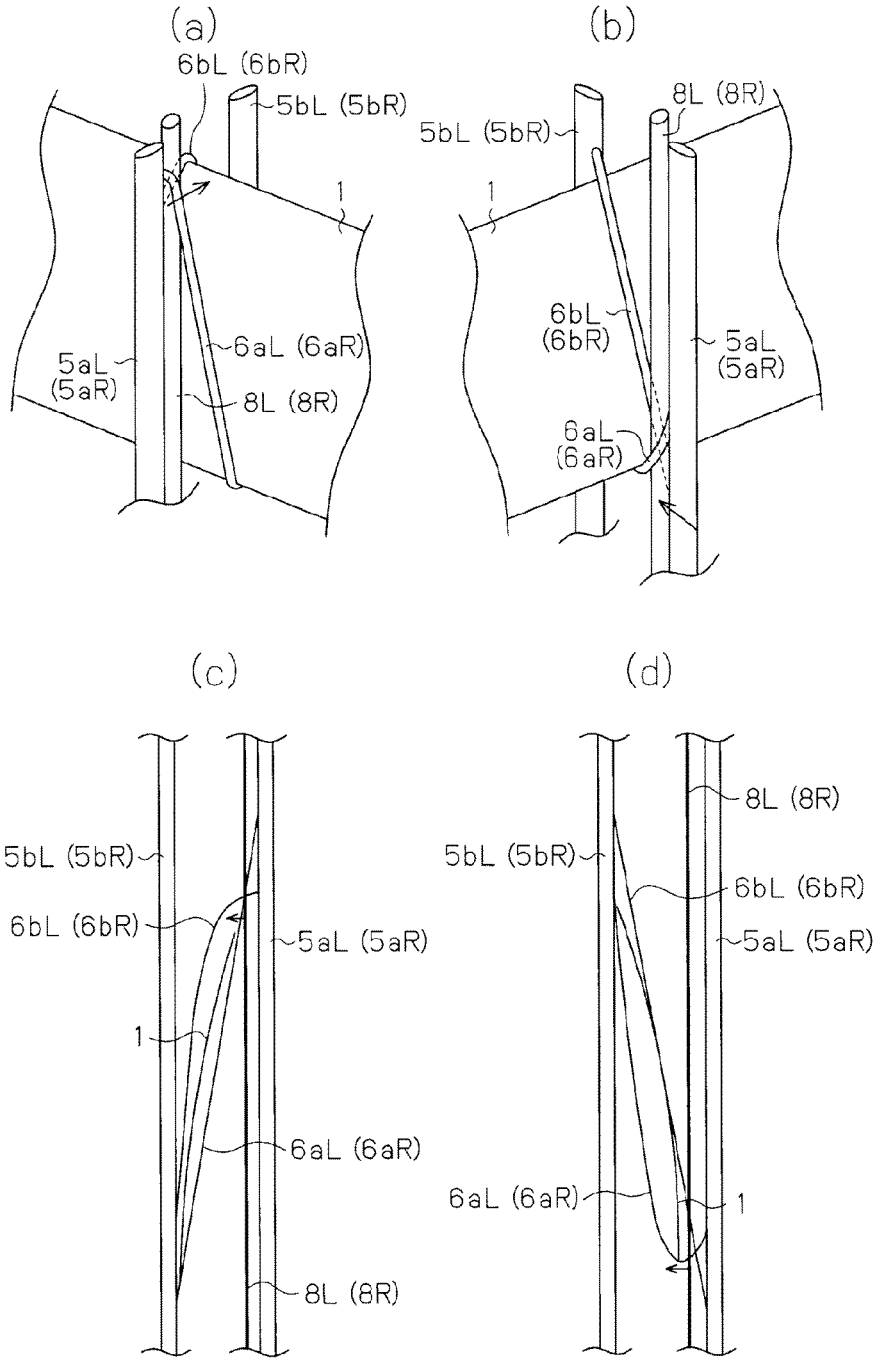
FIG. 21 is a view explaining a sixth embodiment, where (*a*) is a perspective view explaining a working of the lifting/lowering cord when the slat is in the fully-closed state; (*b*) is a perspective view explaining a working of the lifting/lowering cord when the slat is in the contrariwise fully-closed state; (*c*) is a side view explaining the working of the lifting/lowering cord when the slat is in the fully-closed state; and (*d*) is a side view explaining the working of the lifting/lowering cord when the slat is in the contrariwise fully-closed state.

FIG. 21 shows a sixth embodiment.

The lifting/lowering cords 8L, 8R are disposed inside the warp threads 5a L, 5b L and 5a R, 5b R, respectively. A force is applied that presses the slat 1 directly in the direction indicated by the arrows in FIGS. 21 (*a*) and 21 (*c*) even though the weft threads 6a L, 6b L, 6a R, 6b R do not intersect as seen from above, and thus, an effect of enhanced shielding performance in the fully-closed state is obtained.

Further, also in the contrariwise fully-closed state, a force is applied that presses the slat 1 directly in the direction indicated by the arrows in FIGS. 21 (*b*) and 21 (*d*) even though the weft threads 6a L, 6b L, 6a R, 6b R do not intersect as seen from above, and thus, an effect of enhanced shielding performance in the contrariwise fully-closed state is obtained.

Seventh Embodiment

Figure 22:
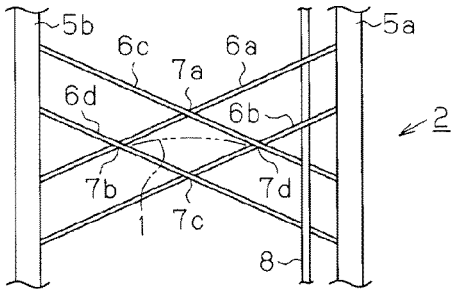
FIG. 22 is a view of a seventh embodiment, explaining a configuration where the slat is supported by four weft threads.

FIG. 22 shows a seventh embodiment.

As shown in FIG. 22, four weft threads, i.e., first to fourth weft threads 6a-6d, are formed between the first warp thread 5a and the second warp thread 5b. These four (first to fourth) weft threads 6a-6d are provided as one group at regular intervals in the vertical direction between the first warp thread 5a and the second warp thread 5b (only one group is shown in FIG. 22).

The first and second weft threads 6a, 6b are formed in parallel with each other between the first warp thread 5a and the second warp thread 5b in a state where the first weft thread 6a is located above the second weft thread 6b. Also, the third and fourth weft threads 6c, 6d are formed in parallel to each other between the first warp thread 5a and the second warp thread 5b in a state where the third weft thread 6c is located above the fourth weft thread 6d.

Further, as shown in FIG. 22, in the ladder cord 2, ends of the first and second weft threads 6a, 6b are formed on the first warp thread 5a so as to be located above ends of the third and fourth weft threads 6c, 6d. On the other hand, ends of the third and fourth weft threads 6c, 6d are formed on the second warp thread 5b so as to be located above ends of the first and second weft threads 6a, 6b.

Therefore, the first weft thread 6a and the third weft thread 6c intersect with each other at an intermediary location thereof, and a first intersecting portion 7a is formed as a result of the intersection.

Further, the first weft thread 6a and the fourth weft thread 6d intersect with each other at a location which is on a side of the first intersecting portion 7a closer to the second warp thread 5b and is below the first intersecting portion 7a, and a second intersecting portion 7b is formed as a result of the intersection.

Moreover, the second weft thread 6b and the fourth weft thread 6d intersect with each other at an intermediary location thereof and below the first intersecting portion 7a, and a third intersecting portion 7c is formed as a result of the intersection.

Furthermore, the second weft thread 6b and the third weft thread 6c intersect with each other at a location which is on a side of the first intersecting portion 7a closer to the first warp thread 5*a* and is below the first intersecting portion 7*a*, and a fourth intersecting portion 7*d* is formed as a result of the intersection.

These four (first to fourth) intersecting portions 7*a*-7*d* form a rhombus in a side view. The slat 1 is inserted in a space of the rhombic shape surrounded by the first to fourth intersecting portions 7*a*-7*d*. Here, the slat 1 is inserted such that the fourth intersecting portion 7*d* is located in the notch 3.

As shown in FIG. 22, the lifting/lowering cord 8 is inserted in a space formed by the second weft thread 6*b*, the third weft thread 6*c* and the first warp thread 5*a* on a side of the first warp thread 5*a*.

Here, as shown in FIG. 22, the lifting/lowering cord 8 is inserted in the space from a side of the first and second weft threads 6*a*, 6*b*, that is, the opposite side of the third and fourth weft threads 6*c*, 6*d*, and lead out to the side of the third and fourth weft threads 6*c*, 6*d*, that is, the opposite side of the first and second weft threads 6*a*, 6*b*. This results in formation of a closed space from which the lifting/lowering cord does not go into the space for inserting the slat.

Accordingly, in this embodiment, the lifting/lowering cord 8 is disposed between the second weft thread 6*b* and the third weft thread 6*c*, so that friction between the lifting/lowering cord 8 and the edge of the slat 1 is prevented. Further, since the slat 1 is engaged with and supported by the fourth intersecting portion 7*d* and the second intersecting portion 7*b*, the slat 1 is arranged symmetrically in the front-back direction, which makes shielding performance even on the front side and the back side.

Note that, in this embodiment, the slat 1 is inserted in the space of the rhombic shape surrounded by the first to fourth intersecting portions 7*a*-7*d*.

Figure 23:
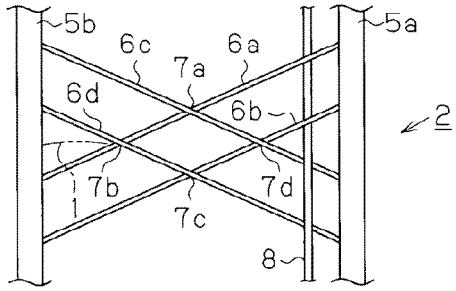
FIG. 23 is a view of another example of the seventh embodiment, explaining a configuration for supporting the slat.

This may be implemented such that, as shown in FIG. 23, on the side of the second warp thread 5*b*, the slat 1 is inserted in a space formed by the first weft thread 6*a*, the fourth weft thread 6*d* and the second warp thread 5*b*. Here, the slat 1 is inserted so as to be located between the second intersecting portion 7*b* and the warp thread 5*b*.

According to this configuration, since two (the second and fourth) intersecting portions 7*b*, 7*d* are interposed on the side of the lifting/lowering cord 8 closer to the slat 1, and the lifting/lowering cord 8 is disposed between the two (first and second) weft threads 6*a*, 6*b* and the two (third and fourth) weft threads 6*c*, 6*d*, friction between the lifting/lowering cord 8 and the slat 1 is prevented, and enhanced durability can be achieved.

Figure 24:
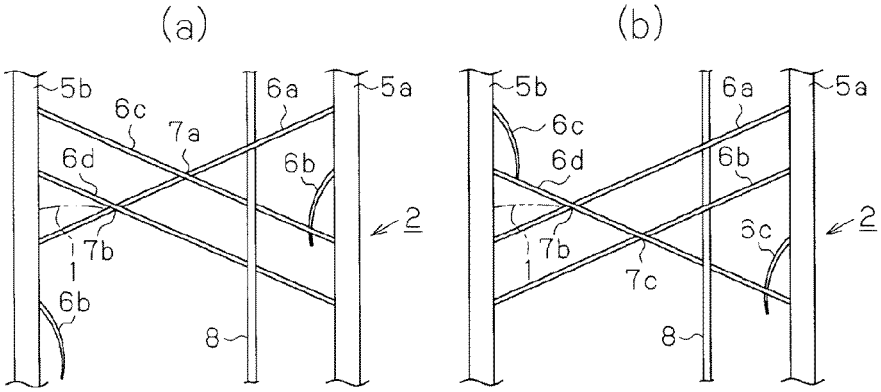
FIGS. 24 (*a*) and (*b*) are views explaining the configuration for supporting the slat when one weft thread is cut.

Further, for example, even if the second weft thread 6*b* is cut as shown in FIG. 24 (*a*) or the third weft thread 6*c* is cut as shown in FIG. 24 (*b*), the slat 1 remains disposed in the space formed by the first weft thread 6*a*, the fourth weft thread 6*d* and the second warp thread 5*b*, and the notch 3 exists at the second intersecting portion 7*b*, so that the slat 1 is still usable.

Figure 25:
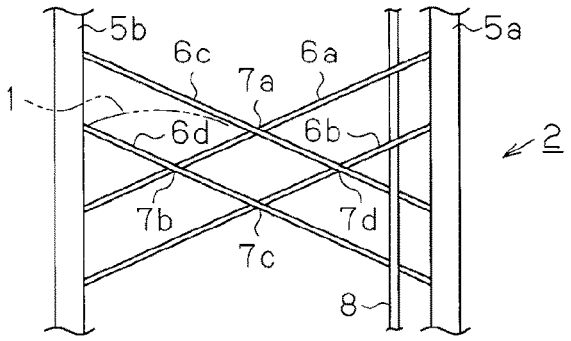
FIG. 25 is a view of another example of the seventh embodiment, explaining a configuration for supporting the slat.

Similarly, the above embodiment may be implemented such that, as shown in FIG. 25, on the side of the second warp thread 5*b*, the slat 1 is inserted in a space formed by the first weft thread 6*a*, the third weft thread 6*c*, the fourth weft thread 6*d* and the second warp thread 5*b*. Here, the slat 1 is inserted so as to be located between the first intersecting portion 7*a* and the warp thread 5*b*.

Also in this case, the same effects can be obtained as in the case where the slat 1 is inserted, as shown in FIG. 23, on the side of the second warp thread 5*b*, in the space formed by the first weft thread 6*a*, the fourth weft thread 6*d* and the second warp thread 5*b*.

Figure 26:
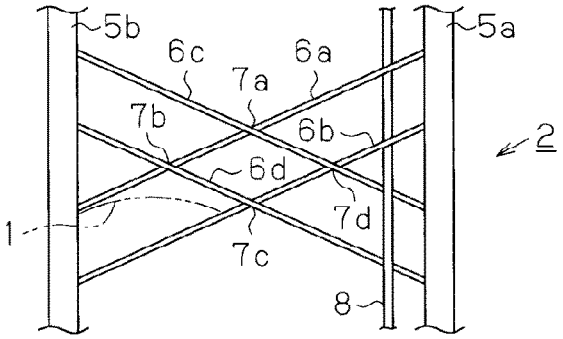
FIG. 26 is a view explaining a configuration for supporting the slat in another example.

Similarly, the above embodiment may be implemented such that, as shown in FIG. 26, on the side of the second warp thread 5*b*, the slat 1 is inserted in a space formed by the first weft thread 6*a*, the second weft thread 6*b*, the fourth weft thread 6*d* and the second warp thread 5*b*. Here, the slat 1 is inserted so as to be located between the third intersecting portion 7*c* and the warp thread 5*b*.

Also in this case, the same effects can be obtained as in the case where the slat 1 is inserted, as shown in FIG. 23, on the side of the second warp thread 5*b*, in the space formed by the first weft thread 6*a*, the fourth weft thread 6*d* and the second warp thread 5*b*.

Figure 27:
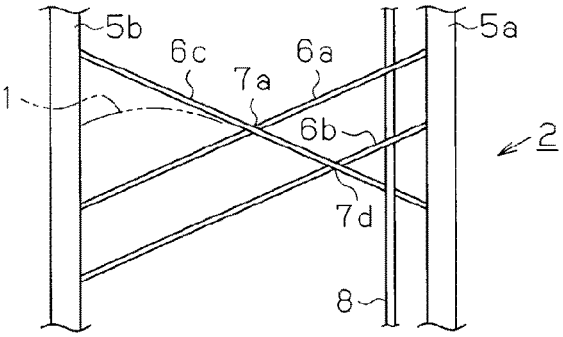
FIG. 27 is a view explaining a configuration for supporting the slat by three weft threads in another example.
Figure 28:
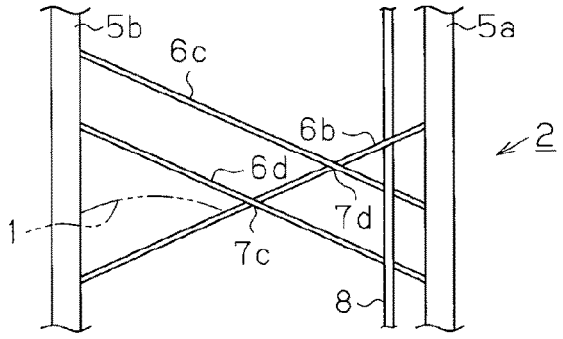
FIG. 28 is a view explaining a configuration for supporting the slat by three weft threads in another example.

Further, as shown in FIG. 28, the above embodiment may be implemented such that either one of the first weft thread 6*a* and the second weft thread 6*b* is omitted (the first weft thread 6*a* is omitted in FIG. 28). Obviously, in contrast as shown in FIG. 27, the above embodiment may be implemented such that either one of the third weft thread 6*c* and the fourth weft thread 6*d* is omitted (the fourth weft thread 6*d* is omitted in FIG. 27).

Figure 29:
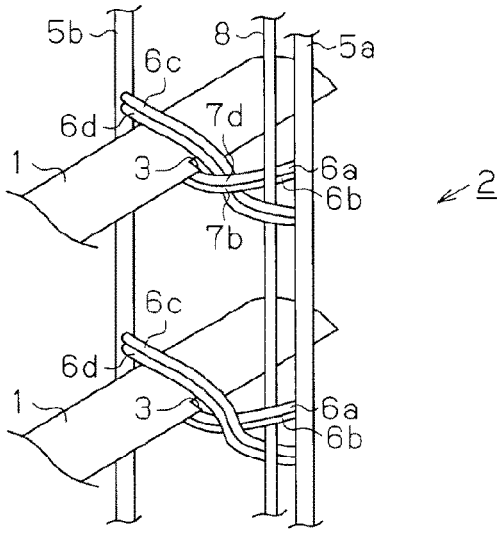
FIG. 29 is a view explaining a manner of inserting the lifting/lowering cord in the seventh embodiment.

Moreover, the above embodiment may be implemented such that, as shown in FIG. 29, the intersections of the first and second weft threads 6*a*, 6*b* with the third and fourth weft threads 6*c*, 6*d* are different between an upper rung and a lower rung. In this case, the lifting/lowering cord 8 is inserted such that, at the second and fourth intersecting portions 7*b*, 7*d* of the first and second weft threads 6*a*, 6*b* and the third and fourth weft threads 6*c*, 6*d*, the first and second weft threads 6*a*, 6*b* intersects with the third and fourth weft threads 6*c*, 6*d* as seen from above (from the head box).

In this configuration, since the first to fourth weft threads 6*a*-6*d* are interposed between the lifting/lowering cord 8 and the edge of the notch 3 of each rung, wear of the lifting/lowering cord 8 can be suppressed further.

Eighth Embodiment

Figure 30:
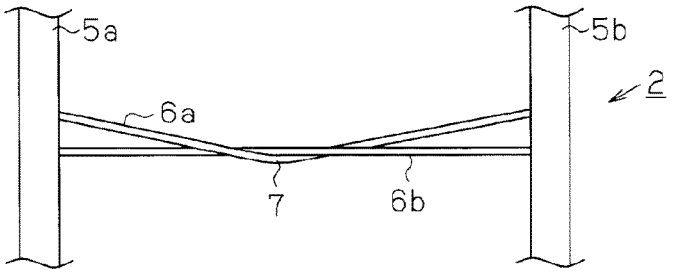
FIG. 30 is a view of an eighth embodiment, explaining a configuration of the weft threads for supporting the slat.
Figure 31:
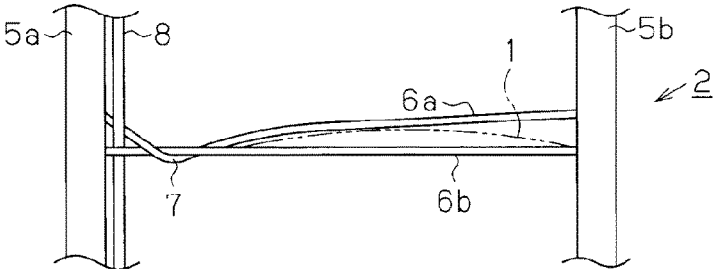
FIG. 31 is a view showing a state where the lifting/lowering cord is inserted.
Figure 32:
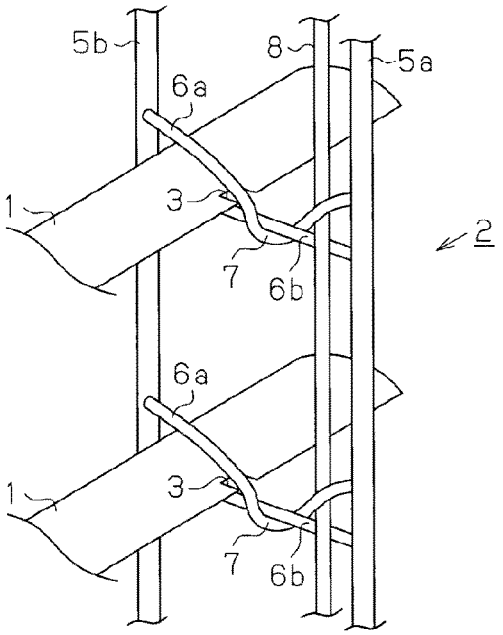
FIG. 32 is a view showing the state where the lifting/lowering cord is inserted.

FIGS. 30 to 32 show an eighth embodiment. This embodiment is characterized in that a ladder cord having a closed space formed beforehand is used eliminating the need for caring the direction of insertion of the lifting/lowering cord.

As shown in FIG. 30, in the ladder cord 2, both ends of the second weft thread 6*b* are formed on the first warp thread 5*a* and the second warp thread 5*b* so as to be located at the same level.

The first weft thread 6*a* is formed such that an end thereof on the side of the first warp thread 5*a* is located above the end of the second weft thread 6*b*. Further, the first weft thread 6*a* is formed such that it passes under (is wound half around) the second weft thread 6*b* and an end thereof on a side of the second warp thread 5*b* is located above the end of the second weft thread 6*b*.

Therefore, the first weft thread 6*a* is coupled to the first warp thread 5*a* and the second warp thread 5*b* in a state where it is engaged with the second weft thread 6*b* located below the first weft thread 6*a*, so that the intersecting portion 7 is formed resulting from that engagement. Consequently, in the ladder cord 2, a closed space is formed in advance by surrounding with the warp thread 5*a* and the weft threads 6*a*, 6*b*.

As shown in FIG. 31 by a double-dotted chain line and in FIG. 32, the slat 1 is inserted between the intersecting portion 7 and the second warp thread 5*b* such that the intersecting portion 7 resulting from the engagement of the first weft thread 6*a* with the second weft thread 6*b* is located in the notch 3.

Further, as shown in FIGS. 31 and 32, the lifting/lowering cord 8 is inserted in the space (closed space) formed between the first weft thread 6*a* and the second weft thread 6*b* at a location between the intersecting portion 7 located within the notch 3 and the first warp thread 5*a*.

Figure 33:
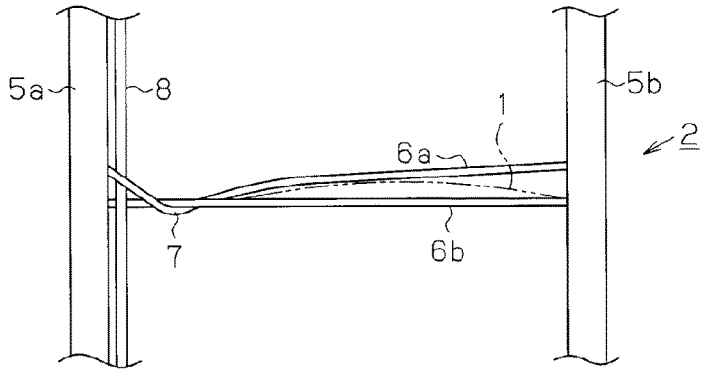
FIG. 33 is a view showing a state where the lifting/lowering cord is inserted in another example.
Figure 34:
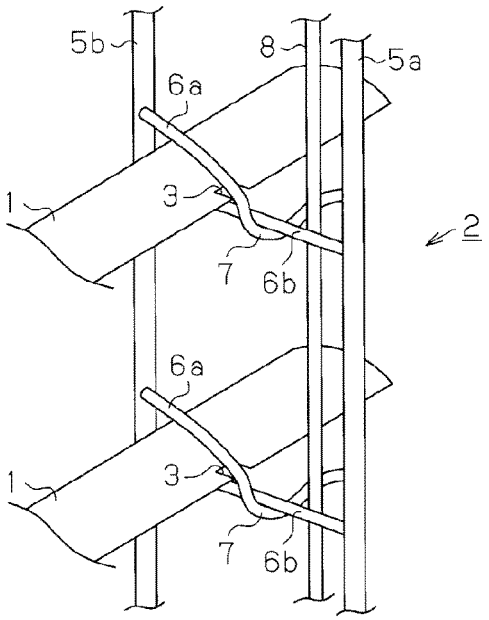
FIG. 34 is a view showing the state where the lifting/lowering cord is inserted in another example.

Here, since the intersecting portion 7 is formed by the engagement of the first weft thread 6*a* and the second weft thread 6*b*, the lifting/lowering cord 8 may be inserted as shown in FIGS. 33 and 34. Also in this case, the lifting/lowering cord 8R does not go to the side of the slat 1 unlike the case where the weft threads 6*a*R, 6*b*R do not intersect as seen from above.

Therefore, according to this embodiment, the first and second weft threads 6*a*, 6*b* are interposed doubly between the lifting/lowering cord 8 and the edge of the notch 3 in each rung, so that wear of the lifting/lowering cord 8 can be suppressed further.

Note that, in the above embodiment, the intersecting portion 7 is formed such that the first weft thread 6*a* passes under the second weft thread 6*b* and, in this state, the end of the first weft thread 6*a* is formed on the side of the second warp thread 5*b* at the location above the second weft thread 6*b*, which configuration is so called a half-engagement (half entanglement).

Figure 35:
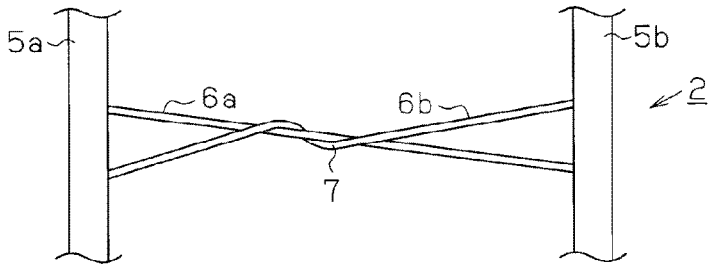
FIG. 35 is a view of another example of the eighth embodiment, explaining a configuration of the weft threads for supporting the slat.

Alternatively, a configuration may be adopted where, as shown in FIG. 35, the second weft thread 6*b* is entangled once with (wound once around) the first weft thread 6*a* to form the intersecting portion 7.

To be more specific, as shown in FIG. 35, in the ladder cord 2, the end of the first weft thread 6*a* is formed on the first warp thread 5*a* so as to be located above the end of the second weft thread 6*b*. Also, the end of the second weft thread 6*b* is formed on the second warp thread 5*b* so as to be located above the end of the first weft thread 6*a*.

Here, the second weft thread 6*b* is wound once around the first weft thread 6*a*, and the both ends of the second weft thread 6*b* are formed on the first warp thread 5*a* and the second warp thread 5*b*.

Figure 36:
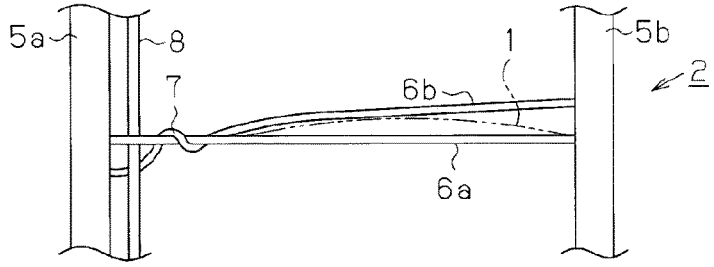
FIG. 36 is a view showing a state where the lifting/lowering cord is inserted.
Figure 37:
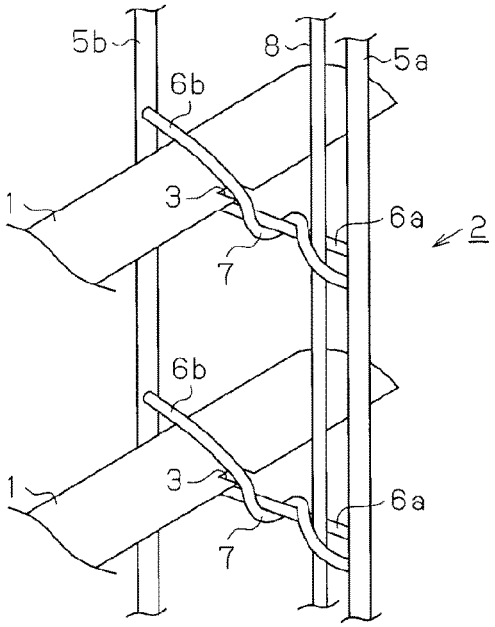
FIG. 37 is a view showing the state where the lifting/lowering cord is inserted.

Further, as shown in FIG. 36 by a double-dotted chain line and in FIG. 37, the slat 1 is inserted between the intersecting portion 7 and the second warp thread 5*b* such that the intersecting portion 7 resulting from the one winding of the second weft thread 6*b* around the first weft thread 6*a* is located in the notch 3.

Further, as shown in FIG. 37, the lifting/lowering cord 8 is inserted in the space formed between the first weft thread 6*a* and the second weft thread 6*b* at the location between the intersecting portion 7 located within the notch 3 and the first warp thread 5*a*.

According to this configuration, similarly, wear of the lifting/lowering cord 8 can be suppressed further.

Ninth Embodiment

Figure 38:
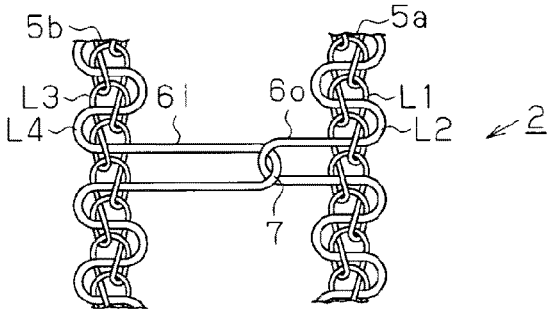
FIG. 38 is a view of a ninth embodiment, explaining a configuration of the weft threads for supporting the slat.
Figure 39:
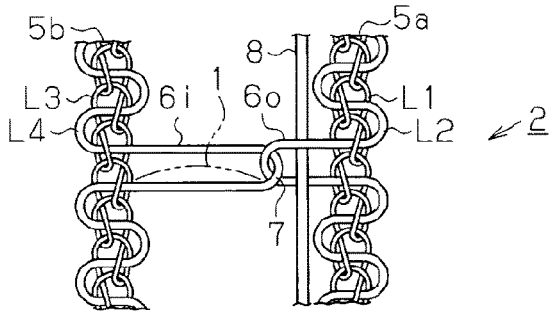
FIG. 39 is a view showing a state where the lifting/lowering cord is inserted.
Figure 40:
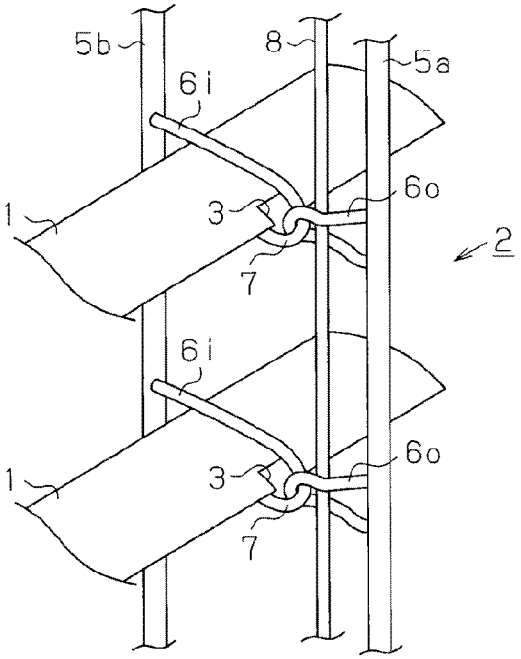
FIG. 40 is a view showing the state where the lifting/lowering cord is inserted.

FIGS. 38 to 40 show a ninth embodiment.

As shown in FIG. 38, in the ladder cord 2, the first warp thread 5*a* is formed by interweaving a second knitting yarn L2 with a first knitting yarn L1 woven from a single yarn such that they are entangled with each other. The second knitting yarn L2 is, while being interwoven with the first knitting yarn L1, pulled out toward the second warp thread 5*b* at regular intervals. The second knitting yarn L2 pulled out toward the second warp thread 5*b*, having a loop shape, is used as an outside weft thread 6*o*.

The second warp thread 5*b* is formed by interweaving a fourth knitting yarn L4 with a third knitting yarn L3 woven from a single yarn such that they are entangled with each other. The fourth knitting yarn L4 is, while being interwoven with the third knitting yarn L3, pulled out toward the first warp thread 5*a* at regular intervals, and inserted in the loop of the outside weft thread 6*o* formed of the second knitting yarn L2. The fourth knitting yarn L4, which is pulled out toward the first warp thread 5*a*, inserted in the loop of the outside weft thread 6*o*, and has a loop shape, is used as an inside weft thread 6*i*.

Thus, the loop of the inside weft thread 6*i* is inserted in the loop of the outside weft thread 6*o* so that the outside weft thread 6*o* and the inside weft thread 6*i* are coupled together, and an intersecting portion 7 is formed between the outside weft thread 6*o* and the inside weft thread 6*i*. As a result, a closed space is formed by the warp thread 5*a* and the outside weft thread 6*o*.

Further, the inside weft thread 6*i* is formed longer than the outside weft thread 6*o*, so as to have a length sufficient to insert the slat 1 therein, as shown in FIG. 39 by a double-dotted chain line.

As shown in FIGS. 39 and 40, the slat 1 is inserted in the loop of the inside weft thread 6*i* such that the intersecting portion 7 resulting from the coupling of the outside weft thread 6*o* and the inside weft thread 6*i* is located in the notch 3.

Similarly, as shown in FIGS. 39 and 40, the lifting/lowering cord 8 is inserted in the space (closed space) formed by the loop of the outside weft thread 6*o* coupled to the inside weft thread 6*i* located in the notch 3.

Thus, according to this embodiment, the outside and inside weft threads 6*o*, 6*i* are interposed between the lifting/lowering cord 8 and the edge of the notch 3 in each rung, so that wear of the lifting/lowering cord 8 can be suppressed further.

Note that the first knitting yarn L1 composing the first warp thread 5*a* and the third knitting yarn L3 composing the second warp thread 5*b* are made of a same material, and the second knitting yarn L2 composing the first warp thread 5*a* and the fourth knitting yarn L4 composing the second warp thread 5*b* are also made of a same material. Alternatively, enhancing the strength of the second knitting yarn L2 of the outside weft thread 6*o* in which the lifting/lowering cord 8 is inserted, by increasing the thickness thereof or using as the material thereof an aramid fiber, an ultrahigh molecular weight polyethylene fiber and the like, which have high tolerability to friction, will produce still better effects. In contrast, the fourth knitting yarn L4 of the inside weft thread 6*i* for supporting the slat 1 may be implemented with a softer fiber, which will facilitate inserting operation of the slat 1.

Figure 41:
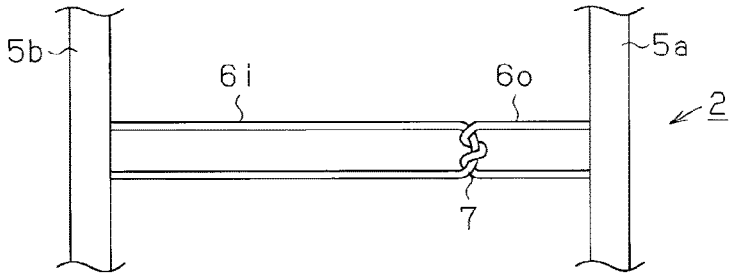
FIG. 41 is a view of another example of the ninth embodiment, explaining a configuration of the weft threads for supporting the slat.
Figure 42:
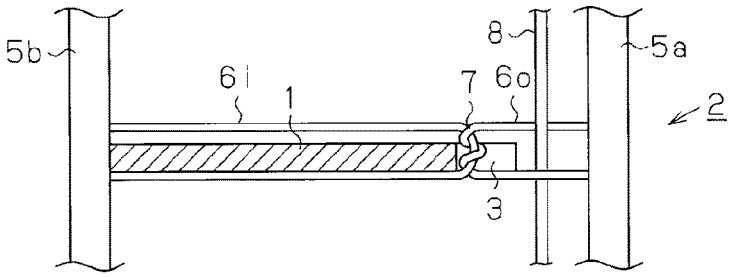
FIG. 42 is a view showing a state where the slat and the lifting/lowering cord are inserted.

Further, as shown in FIGS. 41 and 42, this embodiment may be implemented such that the outside weft thread 6*o* made of the above-mentioned aramid fiber, an ultrahigh molecular weight polyethylene fiber or the like having high tolerability to friction is entangled doubly (or more). This makes it possible to increase strength of the yarn forming the closed space, and thus, enhance frictional property thereof in relation to the lifting/lowering cord 8, while keeping flexibility of the weft threads and maintaining shielding performance of the slat. In this case, by pulled out both the second knitting yarn L2 and the fourth knitting yarn L4 such that the distance between the upper portion and the lower portion of each of the outside weft thread 6*o* and the inside weft thread 6*i* is large, insertion operation of the slat 1 and that of the lifting/lowering cord 8 are both facilitated.

Tenth Embodiment

Figure 43:
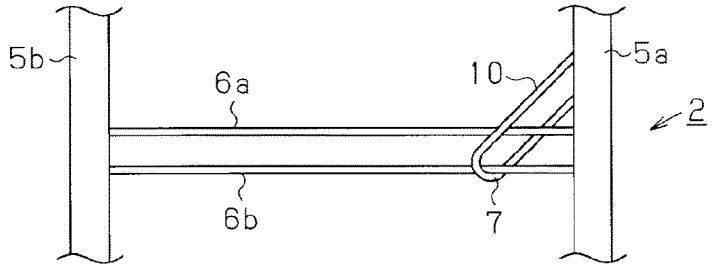
FIG. 43 is a view of a tenth embodiment, explaining a configuration of the weft threads for supporting the slat.
Figure 44:
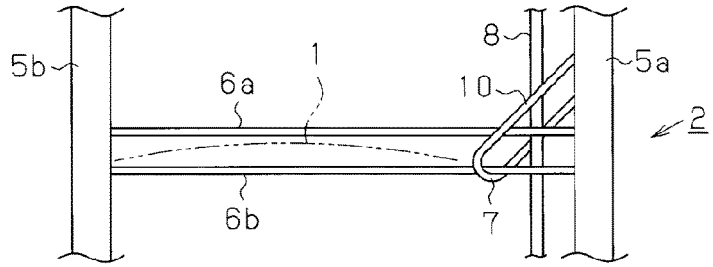
FIG. 44 is a view showing a state where the lifting/lowering cord is inserted.
Figure 45:
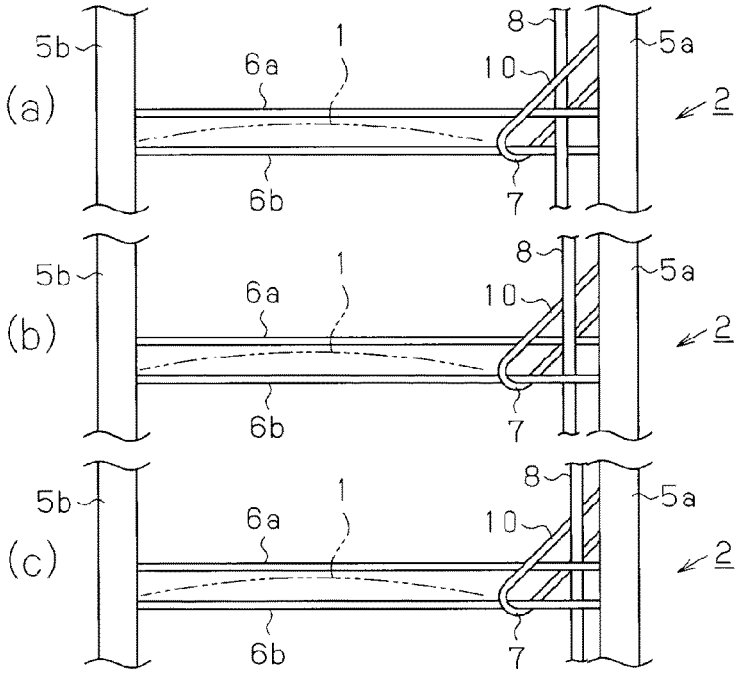
FIGS. 45 (*a*), (*b*) and (*c*) are views showing various states where the lifting/lowering cord is inserted.

FIGS. 43 to 45 show a tenth embodiment.

As shown in FIG. 43, the first weft thread 6*a* and the second weft thread 6*b* are formed horizontally between the first warp thread 5*a* and the second warp thread 5*b* so as to be parallel to each other, with the ends thereof on the warp threads.

Further, a guide ring 10 is provided on the first warp thread 5*a* at a location above the end of the first weft thread 6*a*. The guide ring 10 is provided such that the first and second weft threads 6*a*, 6*b* formed in parallel between the first and second warp threads 5*a*, 5*b* pass therethrough.

Thus, with the first and second weft threads 6*a*, 6*b* inserted in the guide ring 10, an intersecting portion 7 is formed between the guide ring 10 and the second weft thread 6*b*.

As shown in FIG. 44 by a double-dotted chain line, the slat 1 is inserted between the first weft thread 6*a* and the second weft thread 6*b* at a location between the second warp thread 5*b* and the notch 3 such that the intersecting portion 7 is located in the notch 3. Further, as shown in FIG. 44, the lifting/lowering cord 8 is inserted in the guide ring 10 and lead to the guide ring 10 of the next rung, by way of one side of the first and second weft threads 6*a*, 6*b*, and inserted therein.

Thus, in the horizontal blind of this embodiment, the lifting/lowering cord 8 is inserted in the guide ring 10 every pitch of the first and second weft threads 6*a*, 6*b*, so that it is possible to reduce friction of the lifting/lowering cord 8 with the first and second weft threads 6*a*, 6*b*, and friction thereof with the notch 3.

Note that, in this embodiment, the lifting/lowering cord 8 is inserted in the guide ring 10 but lead by way of one side of the first and second weft threads 6*a*, 6*b*.

Alternatively, a configuration may be adopted where, as shown in FIG. 45 (*a*), the lifting/lowering cord 8 is inserted in the guide ring 10 and lead through a space between the first weft thread 6*a* and the second weft thread 6*b*. Further, another configuration may be adopted where, as shown in FIG. 45 (*b*), the lifting/lowering cord 8 is not inserted in the guide ring 10 but lead through the space between the first weft thread 6*a* and the second weft thread 6*b*. Moreover, still another configuration may be adopted where, as shown in FIG. 45 (*c*), the lifting/lowering cord 8 is not inserted in the guide ring 10 nor in the space between the first weft thread 6*a* and the second weft thread 6*b*, but inserted in a space between the guide ring 10 and the first and second weft threads 6*a*, 6*b*.

In this embodiment, both of the first and second weft threads 6*a*, 6*b* are inserted in the guide ring 10.

Figure 46:
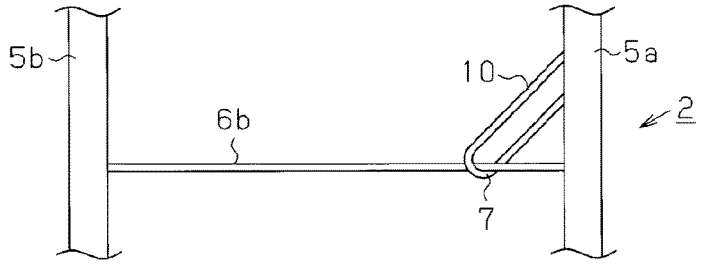
FIG. 46 is a view of another example of the tenth embodiment, explaining a configuration of the weft threads for supporting the slat.
Figure 47:
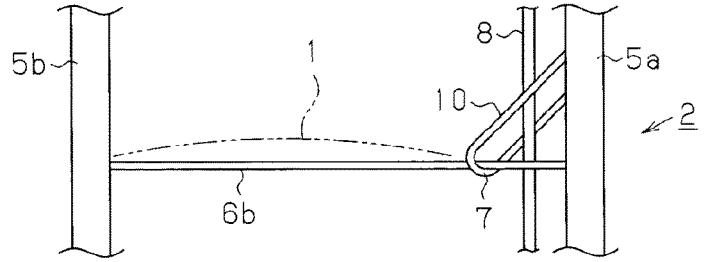
FIG. 47 is a view showing a state where the slat and the lifting/lowering cord are inserted.

In the case where, as shown in FIGS. 46 and 47, only one weft thread (the second weft thread 6*b* in the case of FIG. 46) is formed between the first warp thread 5*a* and the second warp thread 5*b*, that is, in the case where no restriction is required on the top of the slat 1, such a configuration may be adopted where the only one (second) weft thread 6*b* is inserted in a guide ring 10 formed, on the first warp thread 5*a*, of the above-mentioned aramid fiber, ultrahigh molecular weight polyethylene fiber or the like having high tolerability to friction. Further, the slat 1 may be disposed on the second weft thread 6*b* and the lifting/lowering cord 8 may be inserted in the guide ring 10.

Figure 48:
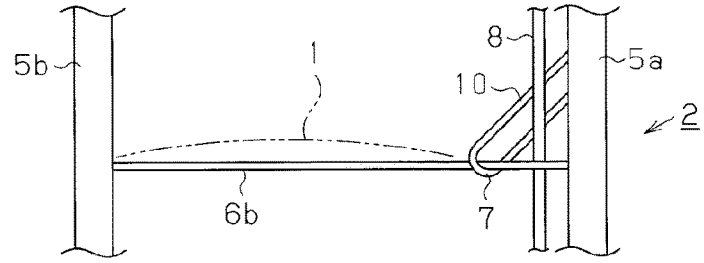
FIG. 48 is a view showing another manner of inserting the lifting/lowering cord.

Moreover, as shown in FIG. 48, a configuration may be adopted where the lifting/lowering cord 8 is not inserted in the guide ring 10 but inserted in a space (closed space) formed between the guide ring 10 and the second weft thread 6*b*.

Eleventh Embodiment

Figure 49:
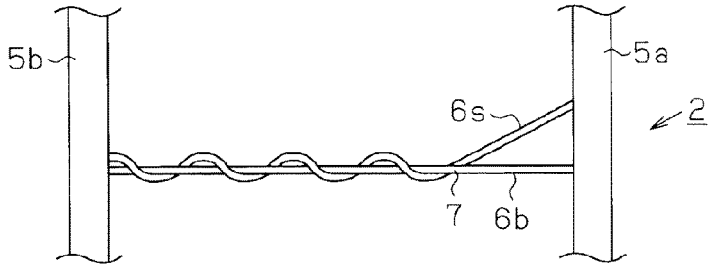
FIG. 49 is a view of an eleventh embodiment, explaining a configuration of the weft threads for supporting the slat.
Figure 50:
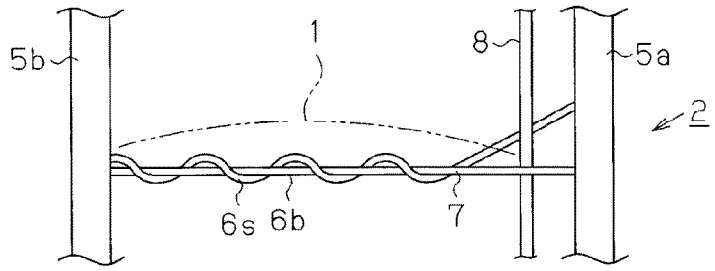
FIG. 50 is a view showing a state where the lifting/lowering cord is inserted.

FIGS. 49 and 50 show an eleventh embodiment.

As shown in FIGS. 49 and 50, one weft thread (second weft thread 6*b* in the case of FIGS. 49 and 50) is formed between the first warp thread 5*a* and the second warp thread 5*b*. A helical weft thread 6*s* is entangled with the second weft thread 6*b* in a helical manner. Here, the entangled helical weft thread 6*s* is fixed to the second weft thread 6*b* through heat-setting with the second weft thread 6*b*.

An end of entanglement, closer to the second warp thread 5*b*, of the helical weft thread 6*s* is in the close vicinity of the second warp thread 5*b*, and an end of the weft thread 6*s* is formed on the second warp thread 5*b* at a location above and near the second weft thread 6*b*. On the other hand, another end of entanglement, closer to the first warp thread 5*a*, of the helical weft thread 6*s* is at a predetermined distance from the first warp thread 5*a*, and another end of the weft thread 6*s* is formed on the first warp thread 5*a* at a location above and at a predetermined distance from the second weft thread 6*b*.

Further, as shown in FIG. 50 by a double-dotted chain line, the slat 1 is disposed above the second weft thread 6*b* such that a detached portion of the helical weft thread 6*s* which is away from the second weft thread 6*b* and formed on the first warp thread 5*a* is located in the notch 3. As shown in FIG. 50, the lifting/lowering cord 8 is inserted in a space (closed space) formed by the detached portion of the helical weft thread 6*s*, the second weft thread 6*b* and the first warp thread 5*a*.

Thus, in the horizontal blind of this embodiment, the detached portion of the helical weft thread 6*s* is located within the notch 3, so that misalignment in the right and left direction, i.e., the longitudinal direction, is prevented. Further, since the lifting/lowering cord 8 is disposed between the detached portion of the helical weft thread 6*s* and the second weft thread 6*b*, friction thereof with the notch 3 of the slat 1 is prevented.

Note that this embodiment is configured such that the helical weft thread 6*s* is formed on the first warp thread 5*a* at a location above the second weft thread 6*b*. Instead of this configuration, as shown in FIG. 51, the end of the helical weft thread 6*s* on the side of the first warp thread 5*a* may be formed on the first warp thread 5*a* at a location below the second weft thread 6*b* and at a predetermined distance therefrom.

Figure 51:
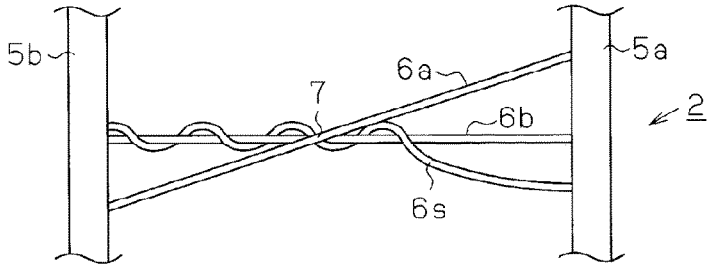
FIG. 51 is a view of another example of the eleventh embodiment, explaining a configuration of the weft threads for supporting the slat.

Alternatively, as shown in FIG. 51, the first weft thread 6*a* is formed, between the first warp thread 5*a* and the second warp thread 5*b*, so as to intersect with the second weft thread 6*b* which is entangled with the helical weft thread 6*s* in a helical manner. To be more specific, an end of the first weft thread 6*a* is formed on the first warp thread 5*a* so as to be located above the end of the second weft thread 6*b*. Also, another end of the first weft thread 6*a* is formed on the second warp thread 5*b* so as to be located below the end of the second weft thread 6*b*.

Therefore, as shown in FIG. 51, the first weft thread 6*a* and the second weft thread 6*b* entangled with the helical weft thread 6*s* intersect with each other at an intermediary location thereof, and an intersecting portion 7 is formed as a result of the intersection.

Figure 52:
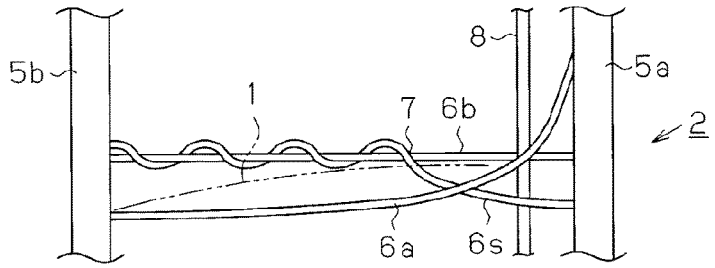
FIG. 52 is a view showing a state where the slat and the lifting/lowering cord are inserted.

Further, a space allowing the slat 1 to be inserted therein is secured between the intersecting portion 7 and the second warp thread 5*b* by sliding the intersecting portion 7 toward the first warp thread 5*a* by means of the operation shaft 9 (see FIG. 5) for inserting the slat 1, and, as shown in FIG. 52 by a double-dotted chain line, the slat 1 is inserted between the first weft thread 6*a* and the second weft thread 6*b* at a location between the intersecting portion 7 and the second warp thread 5*b*.

Further, as shown in FIG. 52, the lifting/lowering cord 8 is inserted in a space (closed space) formed by the detached portion of the helical weft thread 6*s*, the second weft thread 6*b* and the first warp thread 5*a*.

Figure 53:
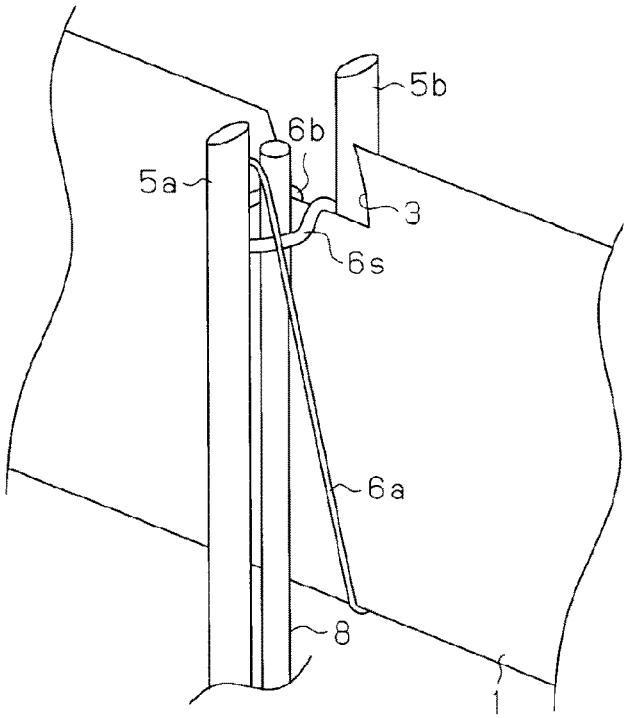
FIG. 53 is a view showing a state of engagement of the first and second weft threads and the notch when the slat is in the contrariwise fully-closed state.

Thus, as show in FIG. 53, the lifting/lowering cord 8 passes between the detached portion of the helical weft thread 6*s* existing within the notch 3 and the second weft thread 6*b*, so that lateral misalignment is restricted not only in the forwardly fully-closed state but also in the contrariwise fully-closed state. Similarly, since the lifting/lowering cord 8 is disposed between the detached portion of the helical weft thread 6*s* and the second weft thread 6*b*, friction thereof with the edge of the notch 3 of the slat 1 is prevented.

Twelfth Embodiment

FIGS. 54 to 58 show a twelfth embodiment.

Figure 54:
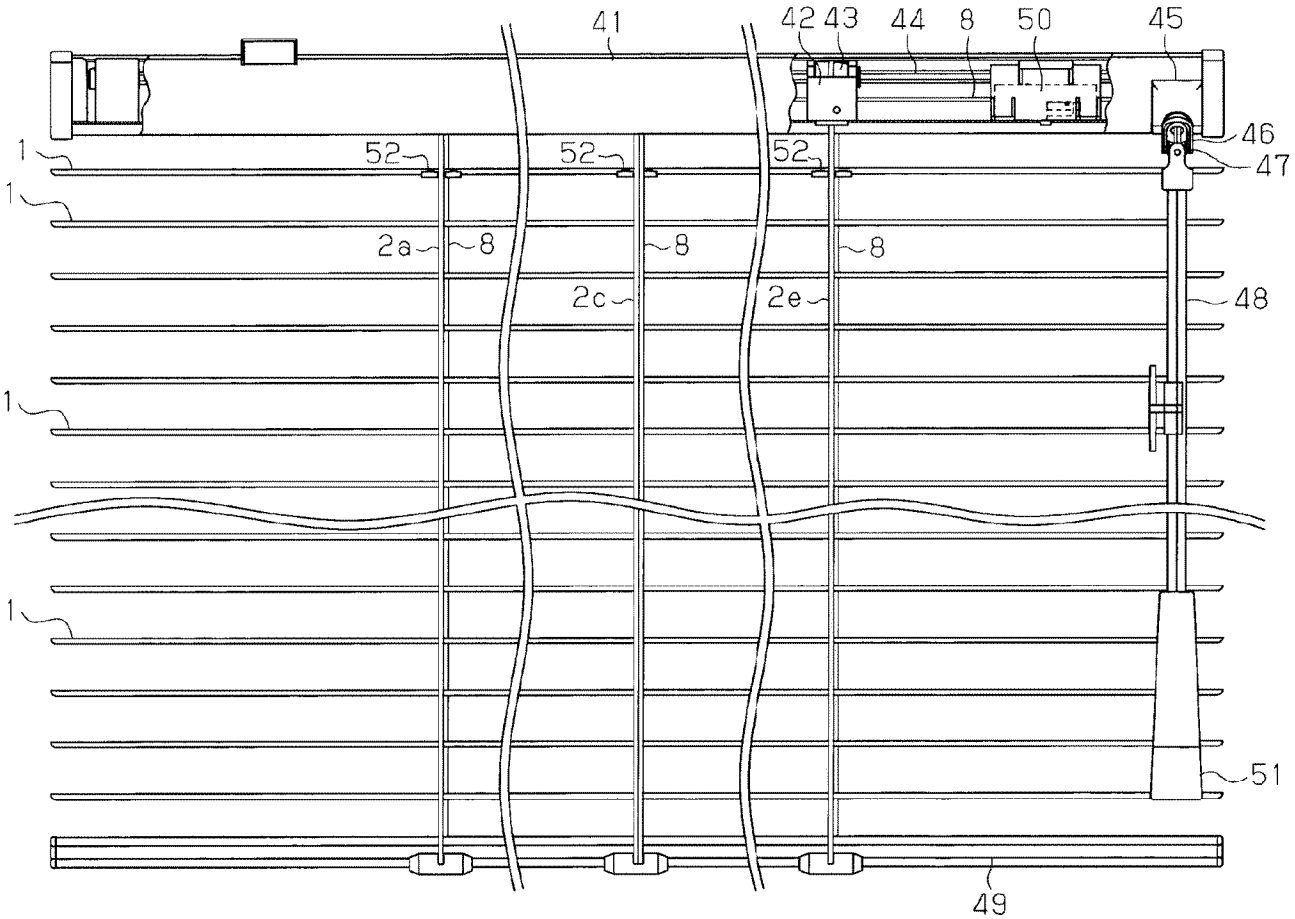
FIG. 54 is a front view of a horizontal blind, explaining a twelfth embodiment.
Figure 55:
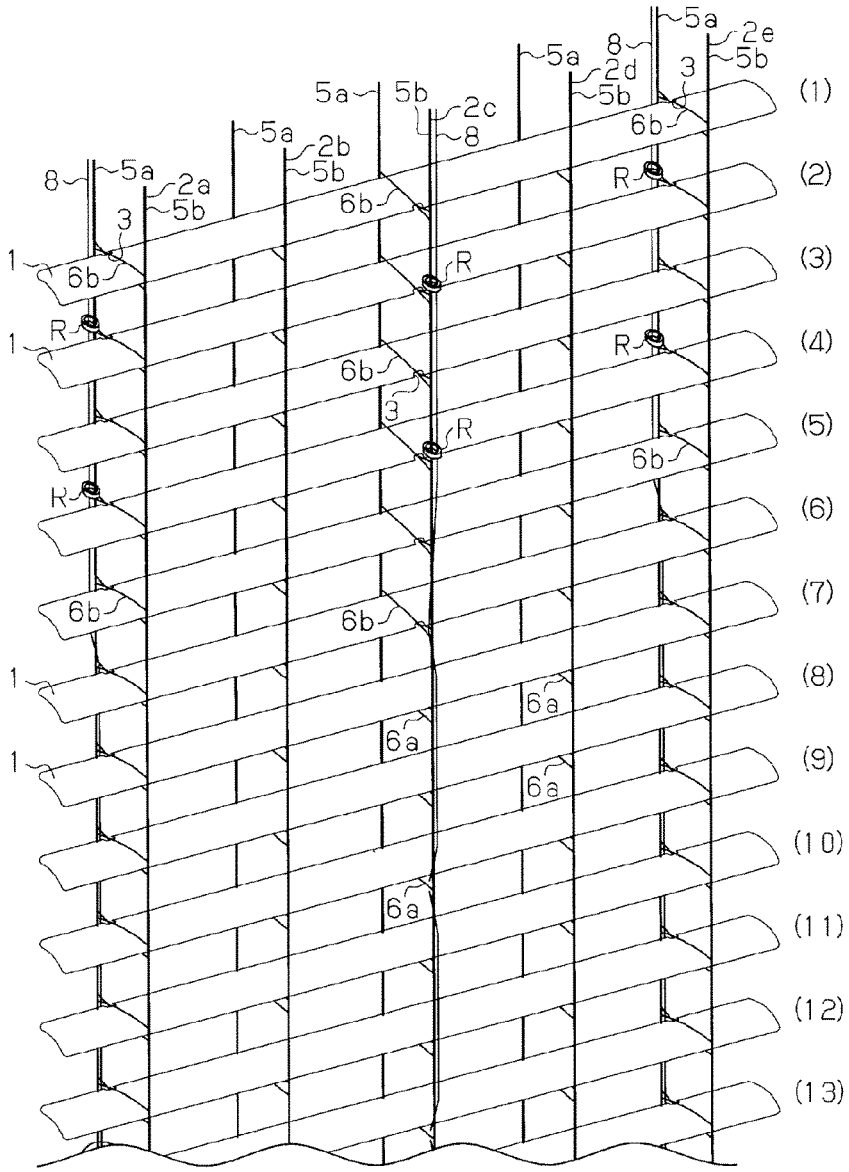
FIG. 55 is a perspective view of the ladder cords to which the slats and the lifting/lowering cords have been attached.

In the horizontal blind shown in FIG. 54, multiple (five in this embodiment, as shown in FIG. 55) ladder cords 2*a*-2*e* are suspended at regular intervals from a head box 41, and a number of rungs of slats 1 are supported by the ladder cords 2*a*-2*e*.

At a location above each of the ladder cords 2*a*-2*e*, a supporting member 42 is disposed in the head box 41, and a ladder cord-suspending shaft 43 is supported so as to be rotatable by the supporting member 42, and an upper end of each of the ladder cords 2*a*-2*e*, is attached to the ladder cord-suspending shaft 43. When the ladder cord-suspending shaft 43 is rotated, the slats 1 are turned in the same phase through the ladder cords 2*a*-2*e*.

An angle-adjusting shaft 44 formed into a hexagonal rod is inserted into the ladder cord-suspending shaft 43 such that their relative rotation is not possible, and one end of the angle-adjusting shaft 44 is fitted with an output shaft of an operation apparatus 45 provided at a right end of the head box 41.

A gear mechanism is arranged in the operation apparatus 45, and an input shaft 46 of the gear mechanism protrudes obliquely downward from the head box 41 toward the interior of the room. Further, an operation rod 48 is suspended from an end of the input shaft 46 via a universal joint 47.

According to the above configuration, the angle-adjusting shaft 44 is rotated by a rotational operation of the operation rod 48 through the operation apparatus 45, so that the ladder cord-suspending shaft 43 is rotated integrally with the angle-adjusting shaft 44.

In the vicinities of the suspending locations of the ladder cords 2*a*, 2*c*, 2*e* among the ladder cords 2*a*-2*e*, suspended at both sides of the head box 41 in the longitudinal direction and at an intermediary location, three lifting/lowering cords 8 are suspended from the head box 41. Among the three lifting/lowering cords 8, the lifting/lowering cords 8 suspended at the both sides of the head box 41 extend downward along first warp threads 5*a* of the ladder cords 2*a*, 2*e* on the side of the slat 1 facing exterior of the room, and the lifting/lowering cord 8 suspended at the intermediary location of the head box 41 extends downward along a second warp thread 5*b* of the ladder cord 2*c* on the side of the slat 1 facing interior of the room.

A bottom rail 49 is attached to lower ends of the ladder cords 2*a*-2*e* and the lifting/lowering cords 8. When the lifting/lowering cords 8 are lifted, the bottom rail 49 is lifted so that the slats 1 are lifted.

Upper ends of the lifting/lowering cords are guided into the head box 41, and, in FIG. 54, guided toward the right end of the head box 41. The upper ends are arranged within the head box 41, inserted in the operation rod 48 by way of a stopper apparatus 50 and the input shaft 46 of the operation apparatus 45, and attached to a cord-equalizer 51 below a handle attached to an lower end of the operation rod 48.

Further, in FIG. 54, slat-restricting members 52 are attached to the slat 1 of the uppermost rung at the locations where the lifting/lowering cords 8 are suspended, and the slat-restricting members 52 are engaged with the first and second warp threads 5*a*, 5*b* of the ladder cords 2*a*, 2*c*, 2*e* and the lifting/lowering cords 8 so as to prevent lateral misalignment of the slat 1.

FIG. 55 is a perspective view showing a state where the multiple slats 1 are supported by the multiple ladder cords 2*a*-2*e*. Note that, in FIG. 55, the slat-restricting members 52 are not shown for convenience of explanation.

Each of the slats 1 is provided with notches 3 at both right and left ends at one side thereof (on a side of the first warp threads 5*a*), as shown in FIG. 55. Further, each of the slats 1 of the first to sixth rungs from the top is formed with a notch 3 at a middle position at another side thereof (on a side of the second warp threads 5*b*).

To each rung of each of the ladder cords 2*a*-2*e*, the configuration of the first embodiment shown in FIG. 3 is applied.

Figure 56:
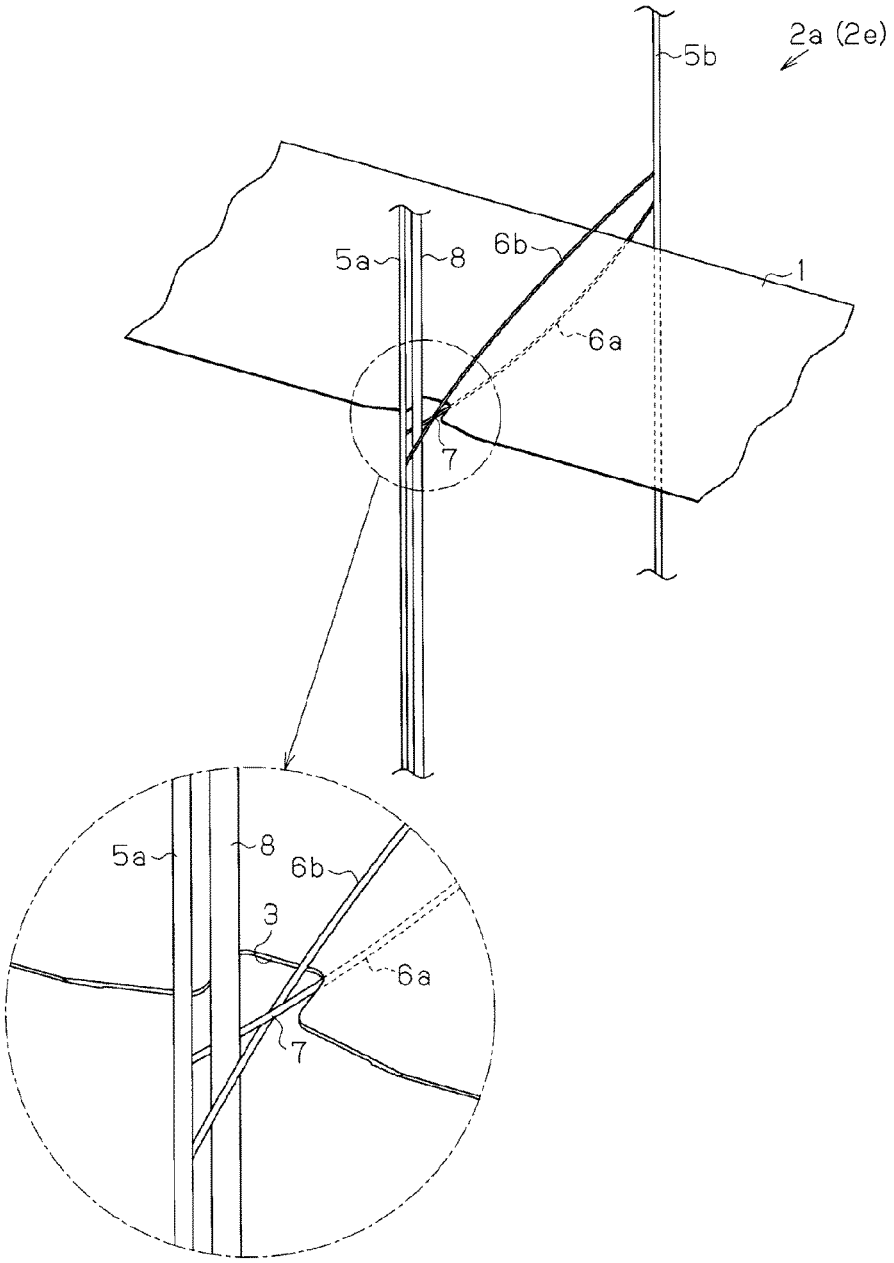
FIG. 56 is a view showing a state where the lifting/lowering cord is inserted in the ladder cord in which the slat has been inserted.

As shown in FIGS. 55 and 56, the slat 1 of each rung is, in a relationship of the right and left sides thereof to the right and left ladder cords 2*a*, 2*e*, inserted in a space formed by the intersecting portion 7, the first weft thread 6*a*, the second weft thread 6*b* and the second warp thread 5*b* such that the intersecting portion 7 is located in the notch 3 formed on the side of the first warp thread 5*a*.

Figure 57:
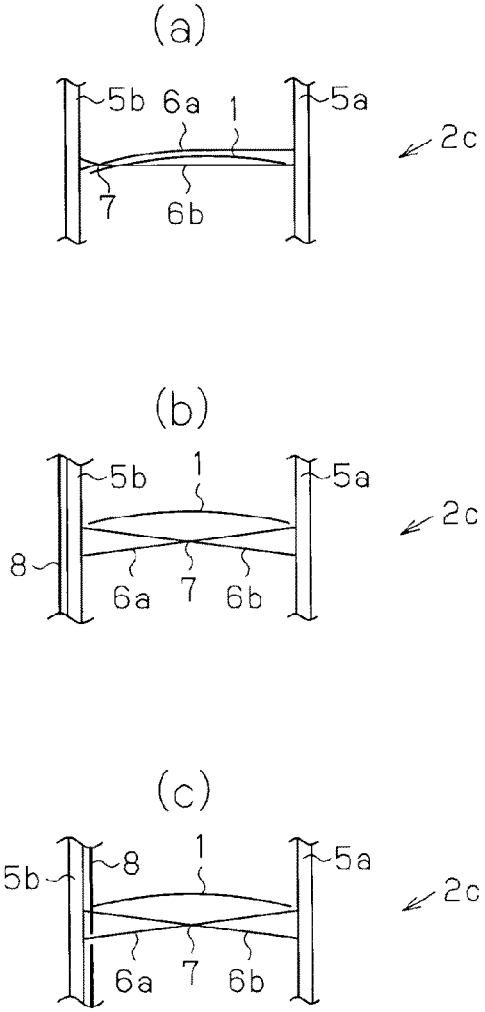
FIGS. 57 (*a*)-(*c*) are views showing supporting states of the slat.

Further, a middle portion of each slat 1 of the first to sixth rungs from the top in FIG. 55 is, as shown in FIG. 57 (*a*), in relation to the central ladder cord 2*c*, inserted in a space formed by the intersecting portion 7, the first weft thread 6*a*, the second weft thread 6*b* and the first warp thread 5*a* such that the intersecting portion 7 is located in the notch 3 formed on the side of the second warp thread 5*b*.

A middle portion of each slat 1 of the seventh rung from the top and lower rungs in FIG. 55 is, as shown in FIGS. 57 (*b*) and 57 (*c*), in relation to the central ladder cord 2*c*, disposed on the first weft thread 6*a* and the second weft thread 6*b* intersecting with each other, at a location between the first warp thread 5*a* and the second warp thread 5*b*.

Also, an intermediary portion between the left side and the middle portion of the slat 1 of each rung is, in relation to the ladder cord 2*b* provided between the ladder cord 2*a* at the left side and the central ladder cord 2*c*, disposed on the first weft thread 6*a* and the second weft thread 6*b* intersecting with each other, at a location between the first warp thread 5*a* and the second warp thread 5*b*. Similarly, an intermediary portion between the right side and the middle portion of the slat 1 of each rung is, in relation to the ladder cord 2*d* provided between the ladder cord 2*e* at the right side and the central ladder cord 2*c*, disposed on the first weft thread 6*a* and the second weft thread 6*b* intersecting with each other, at a location between the first warp thread 5*a* and the second warp thread 5*b*.

Further, in the ladder cords 2*a*, 2*e* at the right and left sides, as shown in FIG. 55, rings R are provided in which are inserted portions of the first warp thread 5*a* at locations above the first weft threads 6*a* of the second and fourth rungs from the top, and the lifting/lowering cords 8 at the right and left sides are inserted respectively in the rings R. Further, in the first, third and fifth rungs, the lifting/lowering cords 8 are not inserted in a space formed by the first weft thread 6*a*, the second weft thread 6*b* and the first warp thread 5*a*, at a location between the intersecting portion 7 and the first warp thread 5*a*.

Note that the rings R of the second and fourth rungs may be different in size. For example, a configuration may be adopted where the size of the ring R of the second rung is greater than the size of the ring R of the fourth rung.

Next, in the ladder cords 2*a*, 2*e* at the right and left sides at the sixth rung and lower rungs, as shown in FIG. 56, the lifting/lowering cords 8 at the right and left sides are inserted in the space formed by the first weft thread 6*a*, the second weft thread 6*b* and the first warp thread 5*a*, at the location between the intersecting portion 7 and the first warp thread 5*a*.

On the other hand, in the central ladder cord 2*c*, at the first to sixth rungs from the top in FIG. 55, similarly to the ladder cords 2*a*, 2*e* at the right and left sides, rings R are provided in which are inserted portions of the second warp thread 5*b* at locations above the second weft threads 6*b* of the second and fourth rungs, and the central lifting/lowering cords 8 is inserted in the rings R.

Next, in the ladder cord 2*c* at the sixth rung and lower rungs, the central lifting/lowering cords 8 is, as shown in FIGS. 55 and 57 (*c*), inserted, every three rungs starting from the sixth rung of the central ladder cord 2*c*, in a space formed by the first weft thread 6*a*, the second weft thread 6*b* and the second warp thread 5*b*, at a location between the intersecting portion 7 and the second warp thread 5*b*.

Therefore, as shown in FIGS. 55 and 57 (*b*), the lifting/lowering cord 8 is not inserted in the above-mentioned spaces formed in the first, third, fifth, seventh, eighth, tenth and eleventh rungs.

Note that in the case of inserting the lifting/lowering cord 8 in that space, it is inserted in the same manner as the lifting/lowering cords 8 at the right and left sides.

Figure 58:
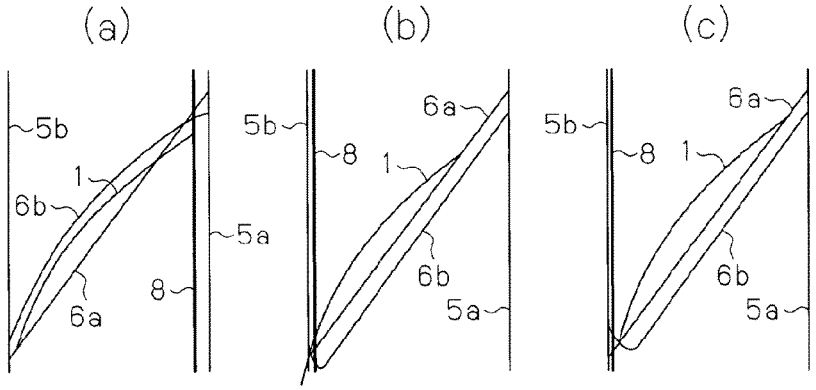
FIG. 58 (*a*) is a view showing a state of the slat at both right and left positions when contrariwise fully closed; (*b*) is a view showing a state of the slat, having the notch, at a middle position when contrariwise fully closed; and (*c*) is a view showing a state of the slat, without a notch, at the middle position when contrariwise fully closed.

According to the configuration described above, when the slats 1 are changed from the horizontal attitude to the contrariwise fully-closed state, both the right and left sides of the slat 1 are arranged as shown in FIG. 58 (*a*). The middle portion of the slat 1 having the notch 3 in the middle portion is arranged as shown in FIG. 58 (*b*), and the middle portion of the slat 1 without the notch 3 in the middle portion is arranged as shown in FIG. 58 (*c*).

As a result, in the contrariwise fully-closed state, as shown in FIGS. 58 (*b*) and 58 (*c*), the first weft thread 6*a* is tightened, and thus, presses the slat 1 in a direction it falls over, so that shielding performance of the slat 1 is increased.

Figure 59:
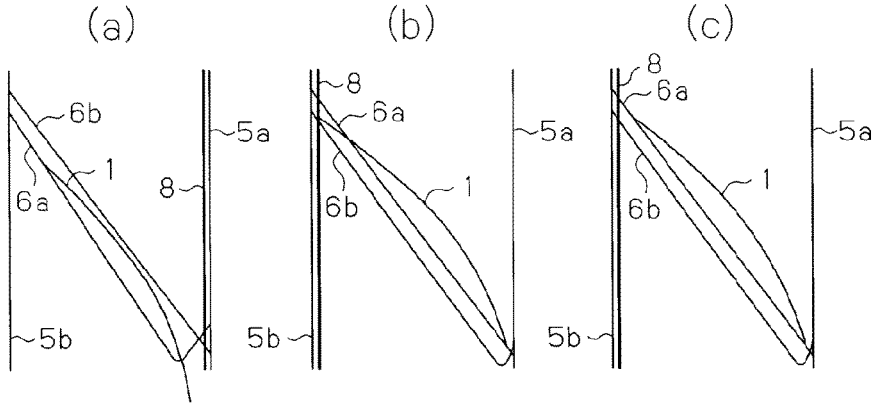
FIG. 59 (*a*) is a view showing a state of the slat at both right and left positions when fully closed; (*b*) is a view showing a state of the slat, having the notch, at a middle position when fully closed; and (*c*) is a view showing a state of the slat, without a notch, at the middle position when fully closed.

In contrast, when the slats 1 are changed from the horizontal attitude to the fully-closed state, both the right and left sides of the slat 1 are arranged as shown in FIG. 59 (*a*). The middle portion of the slat 1 having the notch 3 in the middle portion is arranged as shown in FIG. 59 (*b*), and the middle portion of the slat 1 without the notch 3 in the middle portion is arranged as shown in FIG. 59 (*c*).

As a result, in the fully-closed state, as shown in FIGS. 59 (*b*) and 59 (*c*), the first weft thread 6*a* is tightened, and thus, presses the slat 1 in a direction it falls over, so that shielding performance of the slat 1 is increased.

As described above, according to this embodiment, a horizontal blind can be obtained which has not only the advantageous effects of the other embodiments described previously but also a further enhanced shielding performance.

Note that, in this embodiment, in the ladder cords 2*a*, 2*e* at the right and left sides, the lifting/lowering cord 8 is inserted in the space formed by the first weft thread 6*a*, the second weft thread 6*b* and the first warp thread 5*a*, at the location between the intersecting portion 7 and the first warp thread 5*a*. Also, in the central ladder cord 2*c*, the lifting/lowering cord 8 is inserted in the space formed by the first weft thread 6*a*, the second weft thread 6*b* and the second warp thread 5*b*, at the location between the intersecting portion 7 and the second warp thread 5*b*.

Figure 60:
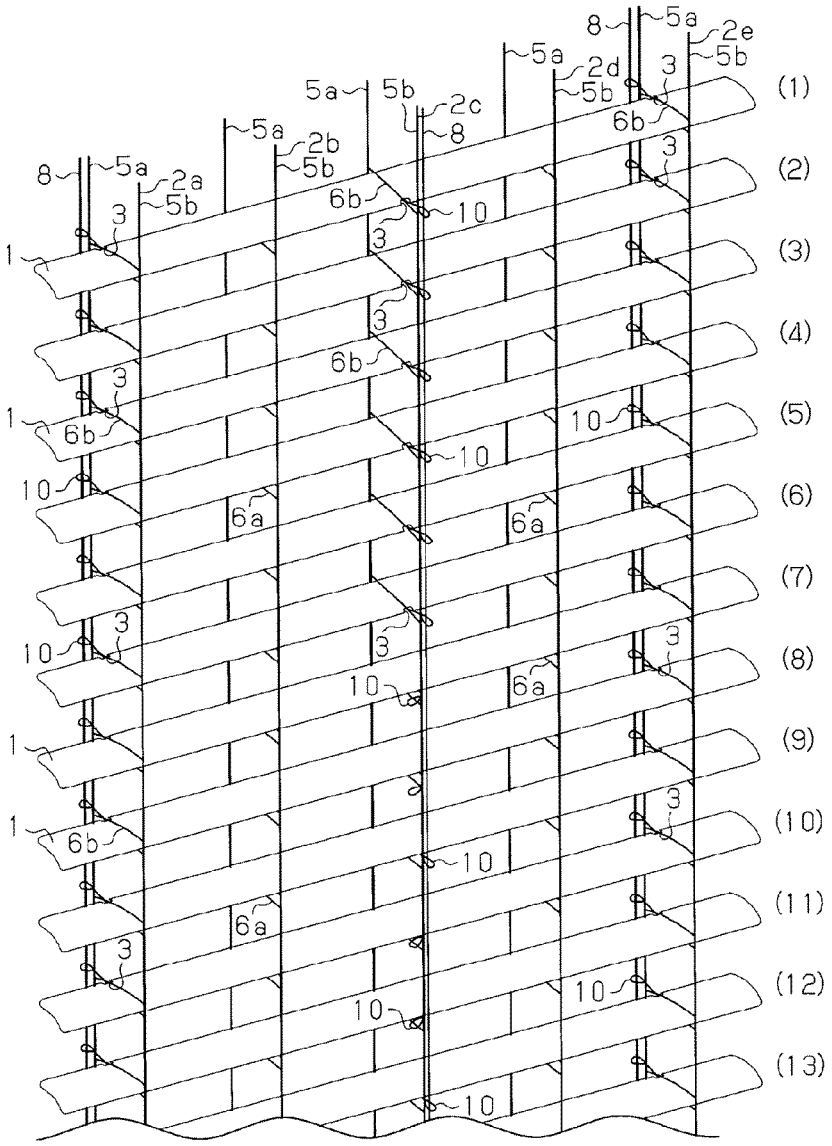
FIG. 60 is a perspective view of another example of the twelfth embodiment, showing the ladder cords to which the slats and the lifting/lowering cords have been attached.

Alternatively, a configuration may be adopted where a guide ring 10 is provided, as shown in FIG. 60, at each rung of the first warp thread 5*a* of the ladder cords 2*a*, 2*c* at the right and left sides and at each rung of the second warp thread 5*b* of the central ladder cord 2*c*, and the lifting/lowering cords 8 are inserted in the guide rings 10.

Figure 61:
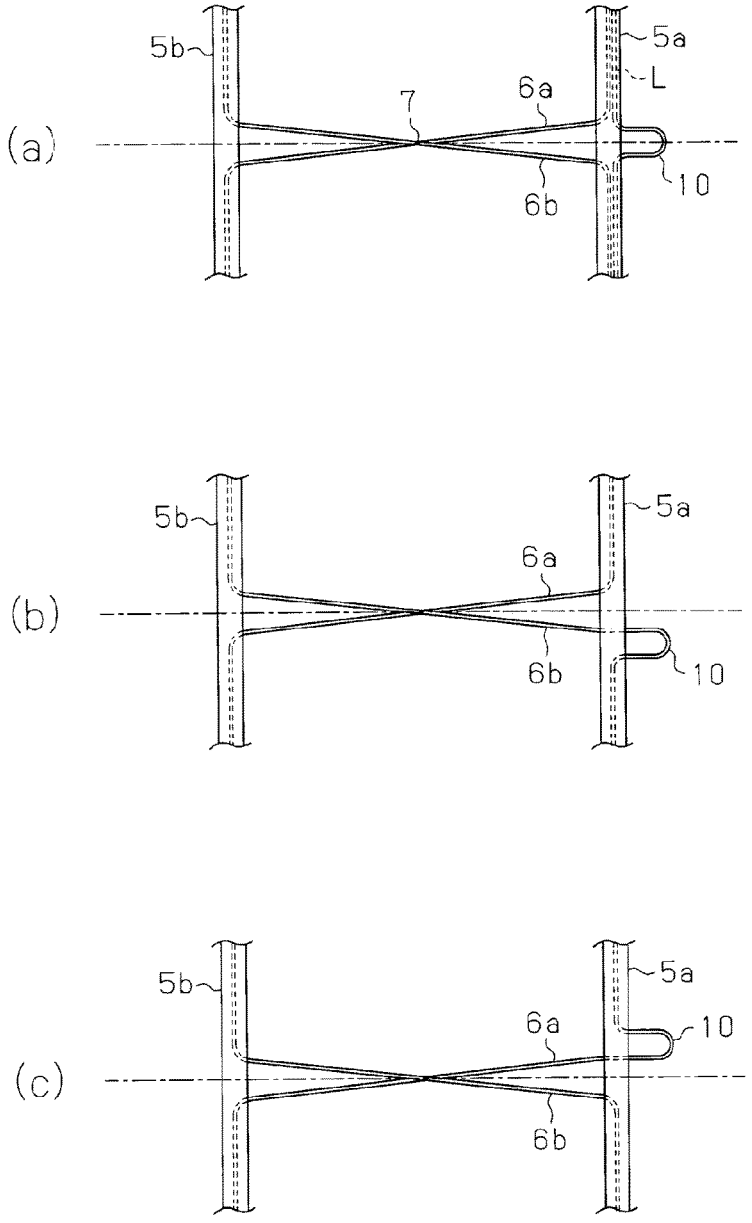
FIGS. 61 (*a*), (*b*) and (*c*) are views explaining a method of forming a guide ring and the first and second weft threads

In this case, the guide rings 10 may be formed, for example, as shown in FIGS. 61 (*a*), 61 (*b*) and 61 (*c*).

Hereafter, a method of forming the first and second weft threads 6*a*, 6*b* as well as the guide ring 10 will be described.

As shown in FIG. 61 (*a*), the first warp thread 5*a* is composed of multiple stings L. The second warp thread 5*b* is also composed of multiple stings L. Further, one (but not necessarily limited to one) string L of the first warp thread 5*a* is pulled out as the first weft thread 6*a* toward the second warp thread 5*b*, and one (but not necessarily limited to one) string L of the second warp thread 5*b* is pulled out as the second weft thread 6*b* toward the first warp thread 5*a*. Here, the one string L of the first warp thread 5*a* that is pulled out as the first weft thread 6*a* and the one string L of the second warp thread 5*b* that is pulled out as the second weft thread 6*b* are pulled out from locations at the same level.

The string L of the first warp thread 5*a* that has been pulled out as the first weft thread 6*a* is used as a string composing the second warp thread 5*b* instead of the string L of the second warp thread 5*b* that has been pulled out, below the location at which the string L of the second warp thread 5*b* has been pulled out. On the other hand, the string L of the second warp thread 5*b* that has been pulled out as the second weft thread 6*b* is used as a string composing the first warp thread 5*a* instead of the string L of the first warp thread 5*a* that has been pulled out, below the location at which the string L of the first warp thread 5*a* has been pulled out.

Then, in the next rung, the string L that was once in the second weft thread 6*b* and is now in the first warp thread 5*a* is pulled out toward the second warp thread 5*b* as the first weft thread 6*a*, in the same manner as above. On the other hand, the string L that was once in the first weft thread 6*a* and is now in the second warp thread 5*b* is pulled out toward the first warp thread 5*a* as the second weft thread 6*b*, in the same manner as above.

Then, similarly, the string L of the first warp thread 5*a* that has been pulled out as the first weft thread 6*a* is used as a string composing the second warp thread 5*b* instead of the string L of the second warp thread 5*b* that has been pulled out. Meanwhile, the string L of the second warp thread 5*b* that has been pulled out as the second weft thread 6*b* is used as a string composing the first warp thread 5*a* instead of the string L of the first warp thread 5*a* that has been pulled out.

Thereafter, by repeating the above process, the first weft thread 6*a* and the second weft thread 6*b* intersecting each other are formed in each of the rungs.

Along with the formation of the first and second weft threads 6*a*, 6*b*, as shown in FIG. 61 (*a*), in the first warp thread 5*a*, one string L among the plural strings of the first warp thread 5*a* other than the string composing the first weft thread 6*a* is pulled out in a shape of a loop, at a location between the first weft thread 6*a* and the second weft thread 6*b*, to form the guide ring 10 of the first warp thread 5*a*. Here, the guide ring 10 is formed at a location at the same level as the intersecting portion 7 of the first weft thread 6*a* and the second weft thread 6*b*.

Note that, as an alternative way of forming the guide ring 10, as shown in FIG. 61 (*b*), the string L that has been pulled out from the second warp thread 5*b* as the second weft thread 6*b* may be pulled out from the first warp thread 5*a* in the form of a loop to form the guide ring 10, before it is used as the string L composing the first warp thread 5*a*.

Further, as shown in FIG. 61 (*c*), the string L that is to be pulled out from the first warp thread 5*a* as the first weft thread 6*a* may be pulled out from the first warp thread 5*a* in the form of a loop to form the guide ring 10, before it is pulled out from the first warp thread 5*a*.

DESCRIPTION OF THE REFERENCE SYMBOLS

1: slat; 2: ladder cord; 2L: left-side ladder cord; 2R: right-side ladder cord; 3: notch; 3L: left-side notch; 3R: right-side notch; 5*a*: warp thread (first warp thread); 5*b*: warp thread (second warp thread); 5*a*L: left-side first warp thread; 5*a*R: right-side first warp thread; 5*b*L: left-side second warp thread; 5*b*R: right-side second warp thread; 6*a*: weft thread (first weft thread); 6*b*: weft thread (second weft thread); 6*i*: inside weft thread; 6*o*: outside weft thread; 6*s*: helical weft thread; 6L: left-side weft thread; 6R: right-side weft thread; 7: intersecting portion; 7*a*-7*d*: first-fourth intersecting portion; 7L: left-side intersecting portion; 7R: right-side intersecting portion; 8: lifting/lowering cord; 8L: left-side lifting/lowering cord; 8R: right-side lifting/lowering cord; 9: operation shaft; 10, 10*a*: guide ring; 30: jig; 31: insertion hole; 32: holding apparatus; 41: head box; 42: supporting member; 43: ladder cord-suspending shaft; 44: angle-adjusting shaft; 45: operation apparatus; 46: input shaft; 47: universal joint; 48: operation rod; 49: bottom rail; 50: stopper apparatus; 51: cord-equalizer; 52: slat-restricting member; R: ring; D: depth; A, W: distance; S: width; H1, H2: thickness; L: string; L1-L4: first-fourth knitting yarn

The invention claimed is:

1. A horizontal blind comprising:

a head box;

a plurality of ladder cords suspended from the head box, each of the ladder cords having first and second warp threads and a weft provided between the two warp threads at each of a plurality of rungs of the ladder cords;

a plurality of slats each supported by the weft at each respective rung of the ladder cords; and a plurality of lifting and lowering cords suspended from the head box, wherein each of the plurality of slats is configured to be turned by operating a ladder cord of the plurality of ladder cords and capable of being lifted or lowered by lifting or lowering the plurality of lifting and lowering cords, wherein the weft at each rung of the ladder cords is formed of first and second weft threads, only one intersecting portion is formed by the first and second weft threads, wherein the slat is inserted into a space which is formed between the first and second weft threads, at a location between the intersecting portion and the first warp thread, and at least one of the lifting and lowering cords is inserted into a space which is formed between the first and second weft threads at a location between the intersecting portion and the second warp thread, wherein the first weft thread is located above the second weft thread on the first warp thread, and the second weft thread is located above the first weft thread on the second warp thread.

2. The horizontal blind of claim 1, wherein a notch that engages with the first and second weft threads is provided in a side edge of each slat on a side where the lifting and lowering cord closest to the notch is arranged.

3. The horizontal blind of claim 1, wherein the at least one lifting and lowering cord inserted between the first and second weft threads at the location between the intersecting portion and the second warp thread is inserted such that the first and second weft threads at the intersecting portion intersect with each other as seen from above.

* * * * *